US006354901B1

(12) United States Patent
Bundo et al.

(10) Patent No.: US 6,354,901 B1
(45) Date of Patent: Mar. 12, 2002

(54) DISCHARGE LAMP, DISCHARGE LAMP SEALING METHOD, DISCHARGE LAMP SEALING DEVICE

(75) Inventors: Tetsuaki Bundo; Koji Kita; Nobuyuki Yamada; Hiroaki Nagai; Hirotaka Ishibashi; Susumu Narita; Koichi Hayashi, all of Kitakyushu (JP)

(73) Assignee: Toto, Ltd., Fukuoka (JP)

( * ) Notice: Subject to any disclaimer, the term of this patent is extended or adjusted under 35 U.S.C. 154(b) by 0 days.

(21) Appl. No.: 09/341,788

(22) PCT Filed: Jan. 16, 1998

(86) PCT No.: PCT/JP98/00158

§ 371 Date: Jul. 16, 1999

§ 102(e) Date: Jul. 16, 1999

(87) PCT Pub. No.: WO98/32147

PCT Pub. Date: Jul. 23, 1998

(30) Foreign Application Priority Data

Jan. 18, 1997 (JP) ..... 9-039686
Apr. 9, 1997 (JP) ..... 9-090726
Jul. 26, 1997 (JP) ..... 9-215890

(51) Int. Cl.[7] ..... H01J 9/00
(52) U.S. Cl. ..... 445/26; 445/43; 445/66
(58) Field of Search ..... 445/43, 26, 66; 392/421

(56) References Cited

U.S. PATENT DOCUMENTS 3,518,411 A * 6/1970 Rohde ..... 392/421
3,628,846 A * 12/1971 Cortorillo ..... 445/26
3,716,285 A 2/1973 Boyce
4,158,485 A * 6/1979 Mueller et al. ..... 445/25
4,184,065 A * 1/1980 Nagashima ..... 392/421
4,214,885 A 7/1980 Nishi
4,412,963 A * 11/1983 Hing ..... 65/33.7
4,689,031 A * 8/1987 Bouchard et al. ..... 445/26
4,746,316 A * 5/1988 Sudo et al. ..... 445/43
5,188,554 A * 2/1993 Snellgrove et al. ..... 445/43
5,192,239 A * 3/1993 Graser ..... 445/26
5,742,124 A * 4/1998 Kees et al. ..... 313/625

FOREIGN PATENT DOCUMENTS

JP 58089756 5/1983
JP 60-69460 5/1985

* cited by examiner

*Primary Examiner*—Kenneth J. Ramsey
(74) *Attorney, Agent, or Firm*—Beyer Weaver & Thomas LLP

(57) ABSTRACT

In a discharge lamp sealing apparatus 30, luminescent substances are charged into an arc tube 11 through an opening 13*b* thereof, and an electrode member 15 is then inserted into the arc tube 11 through the opening 13*b*. A lower end of the arc tube 11 is supported by a support jig 57 in a state that a glass ring 16*c* is placed around the circumference of the opening 13*b*. The arc tube 11 is set in an air-tight condition by a feeding conduit 51 and inserted into a heating unit 40. The heating unit 40 fuses the glass ring 16*c* with heat of an infrared lamp and thereby seals the opening 13*b*. During the sealing process, one end of the arc tube 11 is supported by the support jig 57. The support jig 57 is mainly made of a material having a greater thermal conductivity than that of the material of the arc tube 11, for example, a metal material like Al or Cu. This arrangement enables heat to be readily conducted from the arc tube 11 to the support jig 57 and accordingly prevents a temperature rise in the arc tube 11. This prevents the luminescent substances from being vaporized and released from the arc tube 11.

23 Claims, 24 Drawing Sheets

*Fig. 14*

| Rare Earth Elements | Rare Earth Element(wt%) | $SiO_2$(wt%) | $Al_2O_3$(wt%) | Color | Flowability(※) |
|---|---|---|---|---|---|
| $CeO_2$ | 46.5 | 25.2 | 28.3 | Pale yellow | ○ |
| $CeO_2$ | 58.6 | 19.4 | 22 | Pale yellow | ○ |
| $Nd_2O_3$ | 47.3 | 24.9 | 27.8 | Bluish purple | ◎ |
| $Nd_2O_3$ | 59.4 | 19.1 | 21.6 | Bluish purple | ◎ |
| $Sm_2O_3$ | 48.2 | 24.4 | 27.4 | Pale pink | ○ |
| $Sm_2O_3$ | 60.2 | 18.7 | 21.1 | Pale pink | ○ |
| $Ho_2O_3$ | 50.2 | 23.5 | 26.3 | Pale pink | ○ |
| $Ho_2O_3$ | 62.1 | 17.8 | 20.1 | Pale pink | ○ |
| $Er_2O_3$ | 50.5 | 23.3 | 26.1 | Pink | ○ |
| $Er_2O_3$ | 62.4 | 17.6 | 20 | Pink | ○ |
| $Dy_2O_3$ | 52 | 26 | 22 | Pale yellow | ○ |
| $Y_2O_3$ | 49.5 | 23.7 | 26.8 | White | △ |

DISCHARGE LAMP, DISCHARGE LAMP SEALING METHOD, DISCHARGE LAMP SEALING DEVICE

TECHNICAL FIELD

The present invention relates to a discharge lamp, where luminescent substances are sealed in an arc tube that is mainly made of, for example, a translucent ceramic, as well as to a method of sealing such a discharge lamp and an apparatus for sealing such a discharge lamp.

BACKGROUND ART

In these discharge lamps, an electrode member having a pair of electrodes is fixed in an air-tight manner to an opening of an arc tube, which is mainly made of a translucent ceramic, and luminescent substances, such as mercury, inert gases, and metal halides, are sealed in the air-tight manner in the arc tube. In such discharge lamps, a known method applied to seal the opening of the arc tube in the air-tight manner fuses a sealing glass like a glass frit and seals a gap between the electrode member and the opening of the arc tube with the fused sealing glass.

One known technique uses infrared radiation as a heat source for fusing the sealing glass. When a residual part of the arc tube other than the sealing glass is irradiated with infrared emission, the luminescent substances fly out of the arc tube. The technique can not accordingly attain the desired properties of the discharge lamp.

The object of the present invention is thus to provide a discharge lamp that reduces a fly loss of luminescent substances in an arc tube in the process of sealing an opening of the arc tube by using infrared radiation, as well as a method of sealing such a discharge lamp, and an apparatus for sealing such a discharge lamp.

DISCLOSURE OF THE INVENTION

A first application of the present invention is directed to an apparatus for sealing a discharge lamp, which fuses a sealing glass to seal an opening of an arc tube, through which a luminescent substance has been charged into the arc tube. The apparatus includes: a support jig that supports the arc tube, which is provided with the sealing glass placed around a circumference of the opening; and an infrared irradiation unit that emits infrared radiation to fuse the sealing glass, wherein the support jig is mainly made of a material that has a greater thermal conductivity than that of the arc tube.

The apparatus for sealing a discharge lamp in accordance with the first application of the present invention seals the opening of the arc tube, through which the luminescent substances are charged into the arc tube, by fusing the sealing glass with heat of infrared radiation emitted from the infrared irradiation unit. One end of the arc tube is supported by the support jig. The support jig is mainly made of a material having a greater thermal conductivity than that of the material of the arc tube, for example, a metal material like Al or Cu. This enables heat to be readily conducted from the arc tube to the support jig and thereby prevents a temperature rise in the arc tube. This arrangement effectively prevents the luminescent substances from being vaporized and released from the arc tube.

A cooling unit that lowers the temperature of the support jig is favorably provided to enhance the heat conduction from the arc tube to the support jig.

In accordance with one preferable embodiment of the first application, the apparatus for sealing a discharge lamp further includes an infrared shield that restricts the infrared radiation emitted from the infrared irradiation unit to a periphery of the sealing glass. This structure enables only the sealing glass to be fused for sealing the opening, while shielding the other part of the arc tube from the infrared radiation. This accordingly prevents a temperature rise in the arc tube.

In accordance with one preferable arrangement, the support jig is attached to the infrared shield via a heat-insulator. This arrangement simplifies the attachment structure of the infrared shield. The heat-insulator reduces the quantity of heat conducted from the infrared shield to the support jig. This arrangement accordingly decreases the quantity of heat conducted from the support jig to the arc tube and prevents a temperature rise in the arc tube.

A second application of the present invention is directed to a method of sealing a discharge lamp. The method fuses a sealing glass to seal an opening of an arc tube, through which a luminescent substance has been charged into the arc tube. The method includes the steps of: supporting one end of the arc tube with a support jig; placing the sealing glass around a circumference of the opening; and irradiating the sealing glass with infrared emission to fuse the sealing glass and thereby seal the opening, and cooling the support jig.

The method of sealing a discharge lamp given as the second application cools the support jig down in the course of fusing the sealing glass placed on the arc tube, while the arc tube is supported by the support jig. This arrangement enhances the heat conduction from the arc tube to the support jig and thereby prevents a temperature rise in the arc tube.

A third application of the present invention is directed to an apparatus for sealing a discharge lamp, which fuses a sealing glass to seal an opening of an arc tube, through which a luminescent substance has been charged into the arc tube. The apparatus includes: a support jig that supports one end of the arc tube; a feeding conduit that is arranged to cover the arc tube in an air-tight condition; an infrared irradiation unit; and a heating unit that condenses infrared radiation emitted from the infrared irradiation unit on a predetermined light condensing area, in order to fuse the sealing glass placed around a circumference of the opening of the arc tube. The heating unit has an opening, through which one end of the feeding conduit is protruded outward.

In the third application of the present invention, the opening of the heating unit enables the user to monitor the state in the heating unit. When a part of the feeding conduit is stained, the other end of the feeding conduit that is not projected from the opening is cut off. This shifts the position of the stained part of the feeding conduit relative to the light condensing area of the infrared radiation and thereby favorably avoids frequent replacement with a new feeding conduit.

It is preferable that the heating unit has a transparent window, through which the user can observe the state of fusing the sealing glass and sealing the opening of the arc tube. This arrangement enables the user to securely check the state of sealing the opening with the fused sealing glass.

In accordance with one preferable embodiment of the third application, the heating unit has: a flow length detection unit that measures a flow length of the fused sealing glass flown into the arc tube; and a heating control unit that stops the emission of the infrared irradiation unit when the flow length of the fused sealing glass measured by the flow length detection unit becomes not less than a predetermined value. This arrangement ensures the accurate detection of the flow length of the sealing glass and attains automation without requiring the process of monitoring the sealing state.

A fourth application of the present invention is directed to a discharge lamp, which includes: an arc tube with an opening; an electrode member that is inserted into the arc tube through the opening and has an electrode element; and a halide sealed in the arc tube, wherein electricity is suppled to the electrode member to make the halide radiate. The electrode member has a film layer on a circumference thereof. The film layer includes: a thin film layer that is formed on a specific part, which is in contact with the halide in the arc tube, and includes a halide-resistant material having high corrosion resistance to the halide; and a buffer layer that is interposed between the thin film layer and the circumference of the electrode member and formed to have a medium thermal expansion coefficient, which is between a thermal expansion coefficient of the thin film layer and a thermal expansion coefficient of the electrode member.

In the discharge lamp given as the fourth application, the film layer including the thin film layer and the buffer layer is formed on the electrode member. Since the thin film layer having the resistance to the halide is formed on the specific part that is in contact with the halide, the electrode member has high corrosion resistance to the halide-containing luminescent substances and thereby excellent durability.

The buffer layer is interposed between the electrode member and the thin film layer and has a thermal expansion coefficient, which is between the thermal expansion coefficient of the material of the electrode member and the thermal expansion coefficient of the material of the thin film layer. Even if the discharge lamp is exposed to the heat cycle from ordinary temperature to the emission temperature of the discharge lamp, this configuration reduces the thermal stresses on these interfaces and effectively prevents the thin film layer from coming off the electrode member.

In accordance with one preferable embodiment, the buffer layer contains both the halide-resistant material and a material of the electrode member. The buffer layer has concentration of the halide-resistant material that continuously increases from the electrode member towards the thin film layer.

A fifth application of the present invention is directed to a method of manufacturing a discharge lamp. The method inserts an electrode member into an arc tube through an opening thereof and gives electricity to the electrode material, so as to make a halide, which is sealed in the arc tube, radiate. The method includes the steps of: providing the electrode member; forming a buffer layer, which partly contains a halide-resistant material, on surface of the electrode member; and forming a thin film layer, which comprises the halide-resistant material, around a circumference of the buffer layer.

One preferable method applicable for forming the thin film layer and the buffer layer exposes the electrode member to a halide-resistant material-containing vapor. This attains a continuous increase in concentration of the halide-resistant material included in the buffer layer and causes the thin film layer to be formed on the buffer layer. Typical examples of the halide-resistant material include metals and allows of W, Mo, Zr, and Re.

A sixth application of the present invention is directed to a discharge lamp, which includes: an arc tube having a large-diametral portion that has a hollow chamber filled with a luminescent substance and a small-diametral portion that extends from the large-diametral portion and defines a narrow tubular chamber, which is continuous with the hollow chamber; an electrode member having a sealing base element that is fitted in an opening of the small-diametral portion, a lead element that is arranged to run from the sealing base element to the hollow chamber and to be apart from an inner wall face of the small-diametral portion by a predetermined space, and an electrode element that is disposed on a free end of the lead element; and a sealing glass that is interposed between the inner wall face of the small-diametral portion and an outer surface of the sealing base element, in order to seal the hollow chamber and thereby disconnect the hollow chamber from outside of the arc tube. A length of the lead element is determined to cause a temperature of a specific part of the sealing glass that is exposed to the hollow chamber to be lower than a glass transition temperature, at which the sealing glass is softened, at least at a time of emission of the discharge lamp.

In the discharge lamp given as the sixth application, the arc tube has the large-diametral portion and the small-diametral portion. The large-diametral portion has a hollow chamber, in which luminescent substances are sealed. The hollow chamber is continuous with a narrow tubular chamber defined by the small-diametral portion. The opening of the small-diametral portion is sealed with the sealing base element formed on one end of the electrode member via the sealing glass. The lead element extending from the sealing base element runs through the narrow tubular chamber to the hollow chamber and has the electrode member on the free end thereof. Electricity given to the electrode member having this configuration causes arc discharge and makes the luminescent substances volatile for discharge emission.

At the time of emission of the discharge lamp, the discharge emission raises the temperature in the hollow chamber and causes the thermal energy to be conducted to the sealing glass via the narrow tubular chamber. The length of the lead element is determined to cause the temperature of the specific part of the sealing glass that is exposed to the hollow chamber to be lower than the glass transition temperature. The temperature of the specific part of the sealing glass that is exposed to the hollow chamber is accordingly kept to be not greater than the glass transition temperature, irrespective of the temperature of the luminescent substances and the state of liquid phase and solid phase. This arrangement effectively prevents deterioration of the sealing glass.

In the event that the sealing glass used for the discharge lamp is in a temperature range that is higher than the glass transition temperature, the constituents of the sealing glass are freed from the sealing glass to cause a spectra of the constituents other than the expected spectra of the discharge lamp or to change the intensity of the spectra. This adversely affects the properties of the discharge lamp. In the discharge lamp according to the sixth application of the present invention, however, the sealing glass is kept at lower temperatures than the glass transition temperature and is thus free from such adverse effects.

A seventh application of the present invention is directed to a discharge lamp, which includes: an arc tube that is mainly made of a translucent material and comprises a large-diametral portion, which has a hollow chamber filled with a luminescent substance, and a small-diametral portion, which extends from the large-diametral portion; and an electrode member that is arranged to run from an opening of the small-diametral portion to the hollow chamber and has on a free end thereof an electrode element, which is placed inside the hollow chamber. Electricity is given to the electrode member to cause arc discharge and thereby attain emission of the discharge lamp. The large-diametral portion is formed to cause a temperature of a substantially whole wall surface facing the hollow chamber at a time of the emission of the discharge lamp to be substantially equal to a heat-resistant temperature of the translucent material.

In the discharge lamp given as the seventh application, the large-diametral portion of the arc tube is formed to cause the temperature of the substantially whole wall surface facing the hollow chamber at the time of the emission of the discharge lamp to be substantially equal to the heat-resistant temperature of the translucent material. This arrangement prevents thermal deterioration of the arc tube and heightens the arc temperature in the hollow chamber, thereby improving the emission efficiency.

It is preferable that the arc tube is mainly made of the translucent material having a thermal conductivity of not smaller than 0.9 cal/cm·s·° K. The arc tube is designed to raise the temperature of a coolest part in the small-diametral portion as high as possible at the time of the emission by heat conduction from the large-diametral portion to the small-diametral portion. The large thermal conductivity of the arc tube exerts the following effects. The occurrence of arc discharge on the electrode element of the discharge lamp increases the temperature in the arc tube. The heat is conducted from the large-diametral portion to the small-diametral portion in the arc tube and further from the small-diametral portion to the electrode member, and is released from the electrode member. The large thermal conductivity of the arc tube enables the heat in the large-diametral portion to be quickly conducted to the small-diametral portion and thereby increase the temperature in the small-diametral portion. The luminescent substances located in the coolest part of the small-diametral portion are affected by the temperature rise and improve the emission efficiency in the initial stage, thereby enhancing the total emission efficiency.

In an eighth application of the present invention, the small-diametral portion extending from the large-diametral portion has a low heat conduction part, which is made of a specific material having a lower thermal conductivity than a thermal conductivity of the large-diametral portion and functions to reduce heat conduction from the large-diametral portion to the sealing glass. Since part of the small-diametral portion forms the low heat conduction part having the lower thermal conductivity than the thermal conductivity of the large-diametral portion, this arrangement reduces the heat conduction from the large-diametral portion to the sealing glass via the small-diametral portion. The low heat conduction part reduces the quantity of heat conducted to the sealing glass, even if the arc tube has a high temperature. This arrangement effectively prevents the temperature of the sealing glass from exceeding the glass transition temperature. The whole small-diametral portion, instead of part of the small-diametral portion, may form the low heat conduction part. The location of the low heat conduction part is not restricted as long as it can contribute to a decrease in temperature of the sealing glass.

A tenth application of the present invention is directed to a method of sealing a discharge lamp. The method fuses a sealing glass to seal an opening of an arc tube, through which a luminescent substance has been charged into the arc tube. The method includes the steps of: setting the sealing glass around a circumference of the opening; fusing the sealing glass; and rapidly cooling down the fused sealing glass to make the sealing glass amorphous and thereby seal the opening.

In the method of sealing a discharge lamp given as the ninth application, the fused sealing glass is rapidly cooled down to be amorphous, in the process of sealing the opening of the arc tube with the sealing glass. This configuration enhances the durability to the heat cycle at the time of the emission of the discharge lamp.

In a ninth application of the present invention, the apparatus for sealing a discharge lamp further includes an infrared shield that is disposed around a circumference of the arc tube to condense the infrared radiation only on a periphery of the sealing glass and shield a residual part of the arc tube from the infrared radiation. The infrared shield enables only the periphery of the sealing glass to be heated, while protecting the residual part of the arc tube from heat and the resulting temperature rise. This arrangement thus prevents the luminescent substances from flying out of the arc tube.

It is preferable that one end of the arc tube is supported by a support jig and that an adsorbent is placed in the feeding conduit to adsorb impurities in the process of sealing the arc tube while the feeding conduit is set in the air tight condition. Even if there are impurities in the feeding conduit, the adsorbent adsorbs the impurities and thereby prevents contamination with the impurities, which may cause troubles in the arc tube.

It is also preferable that the support jig has a suspension jig that suspends the electrode member while one end of the arc tube is supported by the support jig. This structure prevents the electrode member from dropping in the arc tube in the course of fusing the sealing glass.

An eleventh application of the present invention is directed to a method of sealing a discharge lamp, The method irradiates a sealing glass with infrared emission to fuse the sealing glass and thereby seal an opening of an arc tube, through which an electrode member with an electrode element is inserted into the arc tube. The method includes the steps of: setting the sealing glass around a circumference of the opening; regulating an atmosphere to make a pressure in the arc tube lower than an external pressure and cause a pressure difference; and heating and fusing the sealing glass to make the fused sealing glass flown into a gap between the electrode member and a wall surface of the opening by mean of the pressure difference.

In the method of sealing a discharge lamp given as the eleventh application, the fused sealing glass is exposed to the pressure difference between the inside and the outside of the arc tube when being flown into the gap between the electrode member and the opening of the arc tube. This arrangement enables the fused sealing glass to be smoothly flown into even a very narrow gap. The flow length of the fused sealing glass is readily controlled by regulating the pressure difference.

One preferable embodiment of the sealing glass includes $Al_2O_3$—$SiO_2$ as a primary constituent and further contains an infrared absorbent to enhance absorptance of infrared radiation. The infrared absorbent is at least one selected among the group consisting of $CeO_2$, $Sm_2O_3$, $Ho_2O_3$, $Dy_2O_3$, $Er_2O_3$, and $Nd_2O_3$. The infrared-absorbing substance contained in, for example, a glass ring enables the infrared radiation to be condensed on the glass ring and rapidly increase the temperature of the glass ring, thereby ensuring completion of the sealing process within a short time period. The shortened heating time effectively restrains a temperature rise in the arc tube and prevents the luminescent substances from flying out of the arc tube. The infrared-absorbing substance may be mixed with a coating material, which is applied onto the surface of the glass ring, instead of being directly mixed with the primary constituent of the glass ring.

BRIEF DESCRIPTION OF THE DRAWINGS

FIG. 14 shows the compositions and colors of various glass rings 16*c* and the results of the sealing process with the glass rings 16*c;*

BEST MODES FOR CARRYING OUT THE INVENTION

Figure 1:
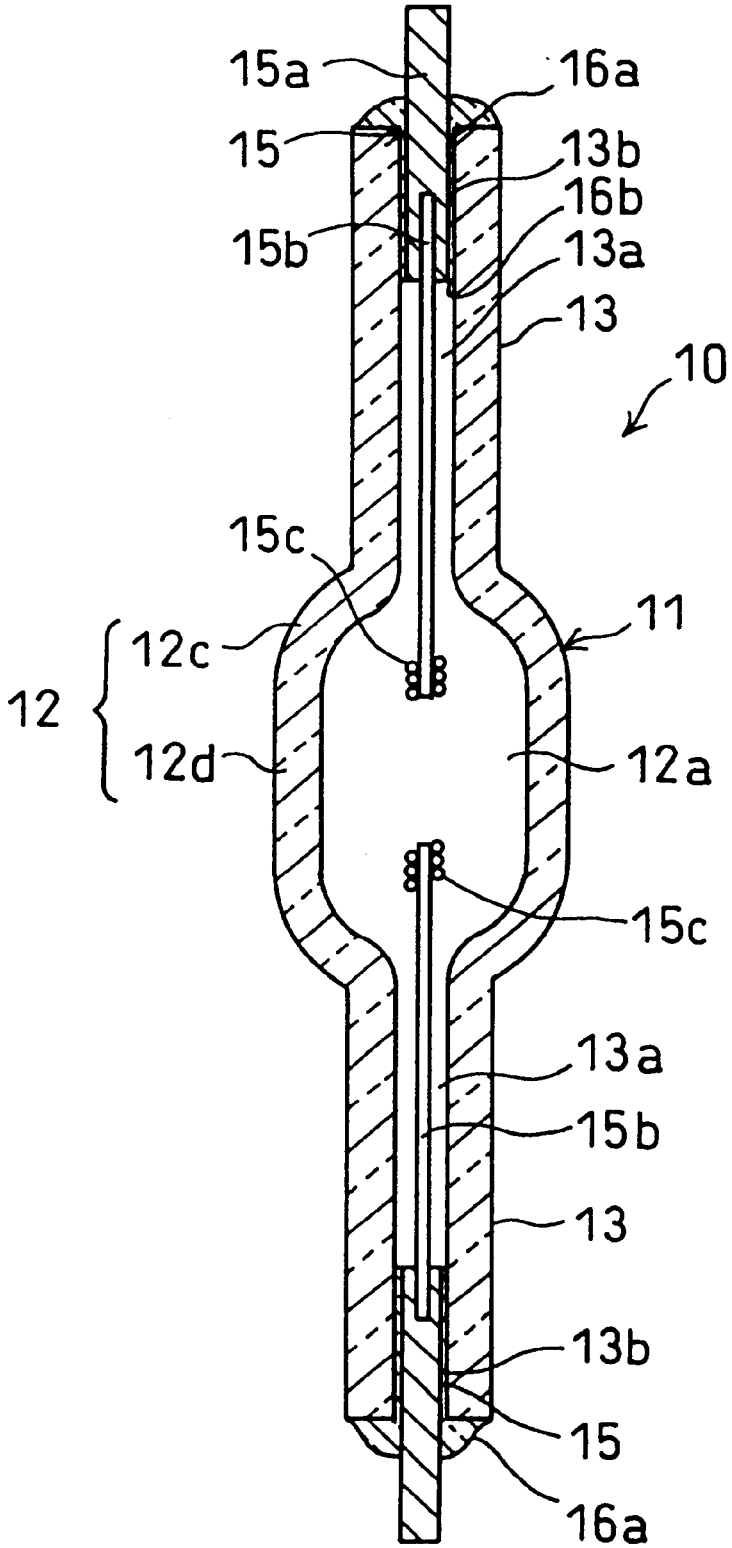
FIG. 1 is a sectional view illustrating a discharge lamp 10 embodying the present invention.

FIG. 1 is a sectional view illustrating a discharge lamp 10 embodying the present invention. Referring to FIG. 1, the discharge lamp 10 includes an arc tube 11 filled with luminescent substances and an electrode member 15. The arc tube 11 has a large-diametral portion 12 including a hollow chamber 12*a* filled with the luminescent substances and a pair of small-diametral portions 13 extending from both ends of the large-diametral portion 12.

The large-diametral portion 12 is formed in a substantially ellipsoidal shape and has wall of a fixed thickness. The pair of small-diametral portions 13 are formed as narrow tubes that are continuous with the respective ends of the large-diametral portion 12, so as to define narrow tubular chambers 13*a* in the respective inner spaces thereof. The small-diametral portions 13 respectively have openings 13*b* that open the narrow tubular chambers 13*a* to the outside.

The arc tube 11 is made of a translucent material, such as alumina, alumina-yttria-garnet, and quartz glass. In the case where $DyI_3$, CsI, Tl, NaI, and the like are applied for the luminescent substances, it is preferable that alumina is used as the main material because they are high reactivity. One applicable method for manufacturing the arc tube 11 prepares a slurry that is mainly made of alumina and carries out casting to integrally form the large-diametral portion 12 with the small-diametral portions 13. The casting facilitates lengthening the small-diametral portions 13 that are continuous with the large-diametral portion 12.

Figure 2:
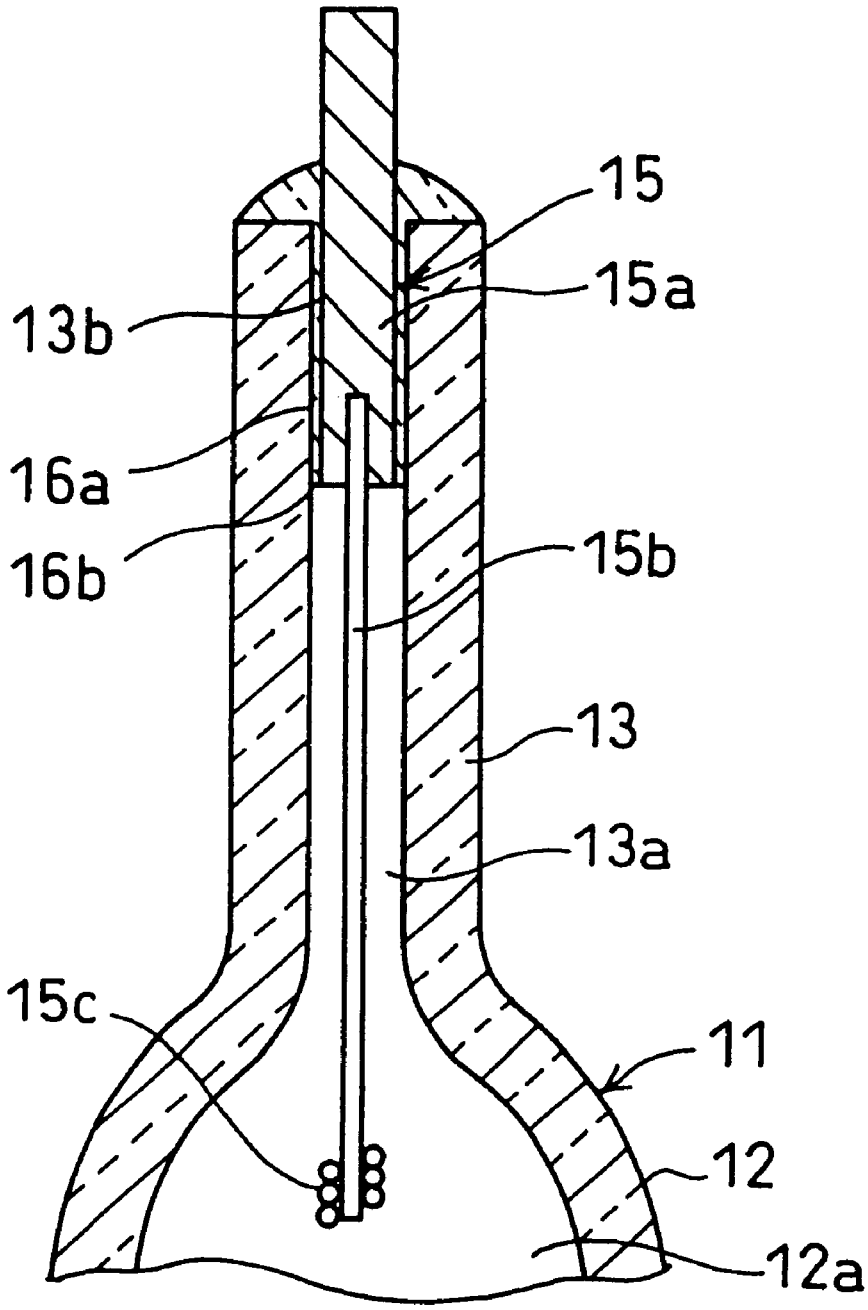
FIG. 2 is an enlarged sectional view illustrating a main part of the discharge lamp 10 shown in FIG. 1.

FIG. 2 is an enlarged sectional view illustrating a main part of the discharge lamp 10 shown in FIG. 1. Referring to FIG. 2, the opening 13*b* of the arc tube 11 is sealed with the electrode member 15. The electrode member 15 includes a sealing base element 15*a* that is fitted in the opening 13*b*, a lead element 15*b* that is arranged to run from an end of the sealing base element 15*a* to the hollow chamber 12*a* through the narrow tubular chamber 13*a*, and an electrode element 15*c* that is disposed on a free end of the lead element 15*b*. The sealing base element 15*a* also works as a terminal connected to an outside lead wire (not shown) and receives a supply of electricity through the connection with the outside lead wire. The lead element 15*b* is apart from the inner wall face of the small-diametral portion 13 by a predetermined space and passes through the center of the narrow tubular chamber 13*a* along the axis thereof. The electrode element 15*c* is connected to the free end of the lead element 15*b* and wound in coil thereon, so that there is a discharge between the electrode element and the opposed electrode element 15*c* via a certain discharge distance.

The following materials may be used for the electrode member 15. The materials having thermal expansion coefficients that are approximately equal to the thermal expansion coefficient of the material for the arc tube 11 are applicable for the sealing base element 15*a*: for example, metals like Nb and Re, alloys like Nb—Zr, and cermets like a metal-B system, a metal-C(N) system, and a metal-Si system. W, Mo, and other similar elements having high melting points are applicable for the lead element 15*b* and the electrode element 15*c*.

A sealing glass 16*a* is interposed between the sealing base element 15*a* of the electrode member 15 and the inner wall face of the opening 13*b*, in order to make the arc tube 11 air-tight to the outside. A variety of compounds, such as an $SiO_2$—$Al_2O_3$—MgO system, an $Al_2O_3$—CaO—$Y_2O_3$ system, and an $Al_2O_3$—$SiO_2$—$Dy_2O_3$ system, are applicable for the sealing glass 16*a* by taking into account the thermal expansion coefficient and other physical properties of the material for the arc tube 11.

The following method may be applied to make a seal with the sealing glass 16*a*. After charging the luminescent substances into the arc tube 11, the method inserts the electrode member 15 into the arc tube 11 through the opening 13*b*. The method then places a glass ring (not shown), which forms the sealing glass 16*a*, on the free end of the opening 13*b* and exposes the glass ring to an atmosphere of Ar gas. The method subsequently irradiates the glass ring with infrared emission, in order to heat and fuse the glass ring. The fused glass ring runs into a gap between the inner wall face of the opening 13*b* and the sealing base element 15*a* and solidifies. This enables the gap between the inner wall face of the opening 13*b* of the arc tube 11 and the outer circumference of the sealing base element 15*a* to be sealed with the sealing glass 16*a*.

The emission of the discharge lamp 10 and its temperature distribution are discussed below. When the discharge lamp 10 is kept in a horizontal orientation and a supply of electricity runs between the electrode members 15,15 of the discharge lamp 10, arc discharge occurs between the electrode elements 15*c*, 15*c*. This gives the discharge energy to the luminescent substances charged in the arc tube 11. Hg vaporizes in an early stage of the arc discharge to heighten the vapor pressure in the arc tube 11. The increase in vapor pressure fulfills the condition required for emission of the other luminescent substances like Dy. The other luminescent substances like Dy excite to the ion state to cause the arc discharge. The shape of the electric arc is substantially elliptical.

Figure 3:
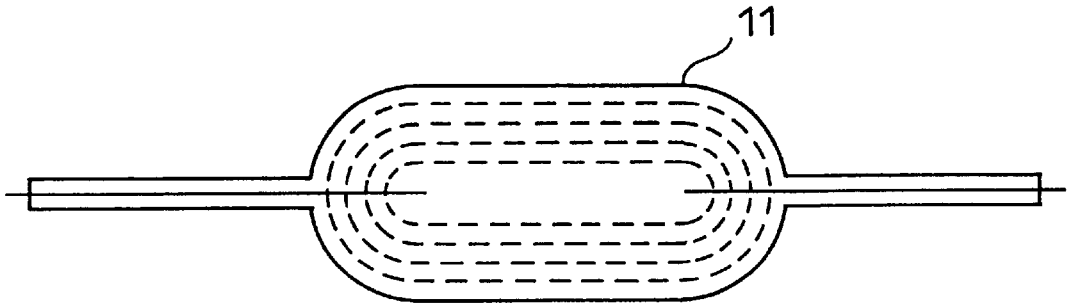
FIG. 3 shows a temperature distribution at the time of emission of the discharge lamp 10.
Figure 3:
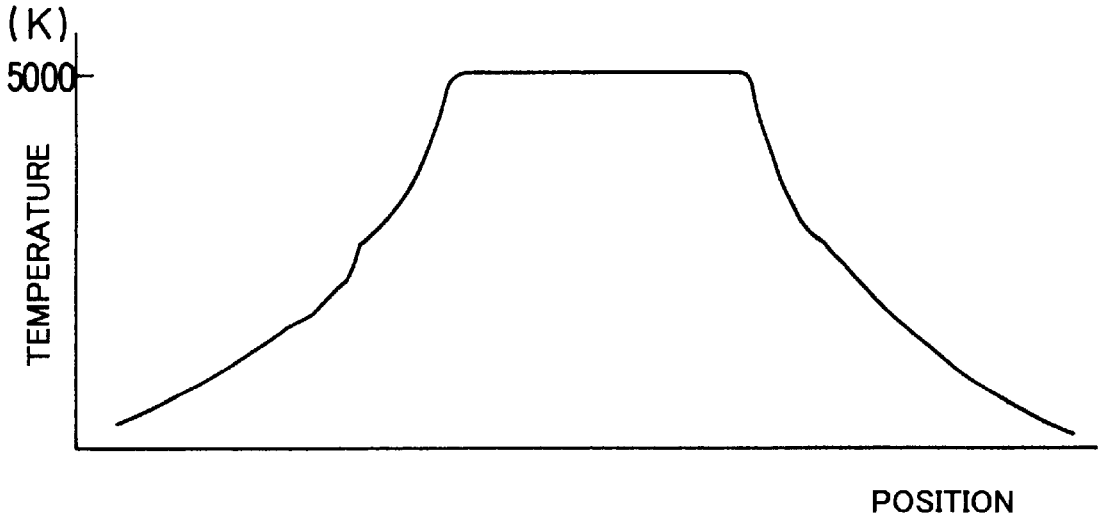

This shape of the electric arc results in a temperature distribution in the arc tube 11 as shown in the graph of FIG. 3. Referring to FIG. 3, the temperature distribution has a substantially elliptical shape, where the temperature is about 5,000 K in a central area of the arc and gradually decreases with an increase in distance apart from the central area. In order to enhance the emission efficiency of the discharge lamp 10 in such a temperature distribution, it is preferable to heighten the temperature in the arc tube 11 over the whole range. There is, however, a limit of the temperature rise, due to the heat-resistant temperatures of the arc tube 11 and the sealing glass 16*a*. The discharge lamp 10 has a configuration discussed below in order to enhance the emission efficiency of the arc tube 11 under such conditions.

Figure 4:
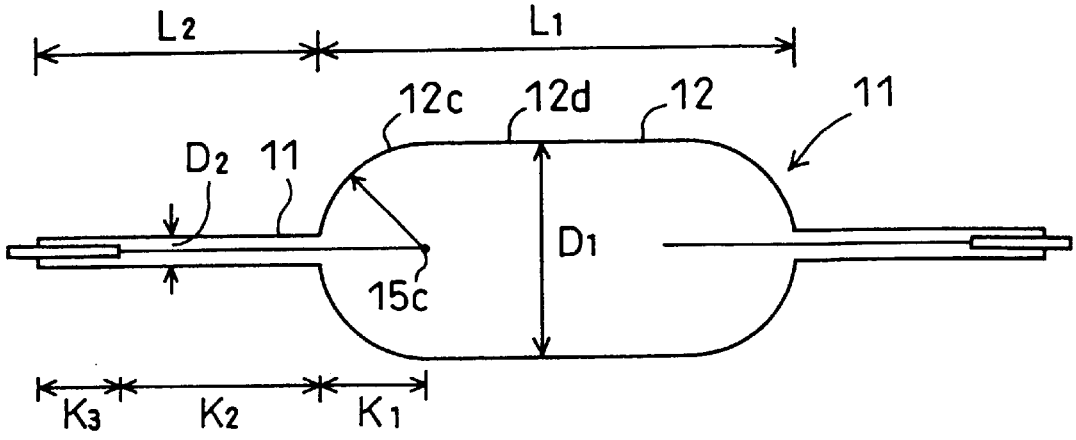
FIG. 4 shows dimensions of the respective constituents of the discharge lamp 10.

FIG. 4 shows dimensions of the respective constituents of the discharge lamp 10. In the arc tube 11 shown in FIG. 11, the large-diametral portion 12 has a length L1 and an inner diameter D1, whereas the small-diametral portion 13 has a length L2 and an inner diameter D2. In the electrode member 15, K1 defines a position of the electrode element 15*c* in the hollow chamber 12*a* and namely denotes a length from the joint of the small-diametral portion 13 with the large-diametral portion 12 to the electrode element 15*c*. K2 denotes a length from the joint to an inner end of the sealing base element 15*a*, and K3 denotes a length sealed with the sealing glass 16*a*.

Figure 5:
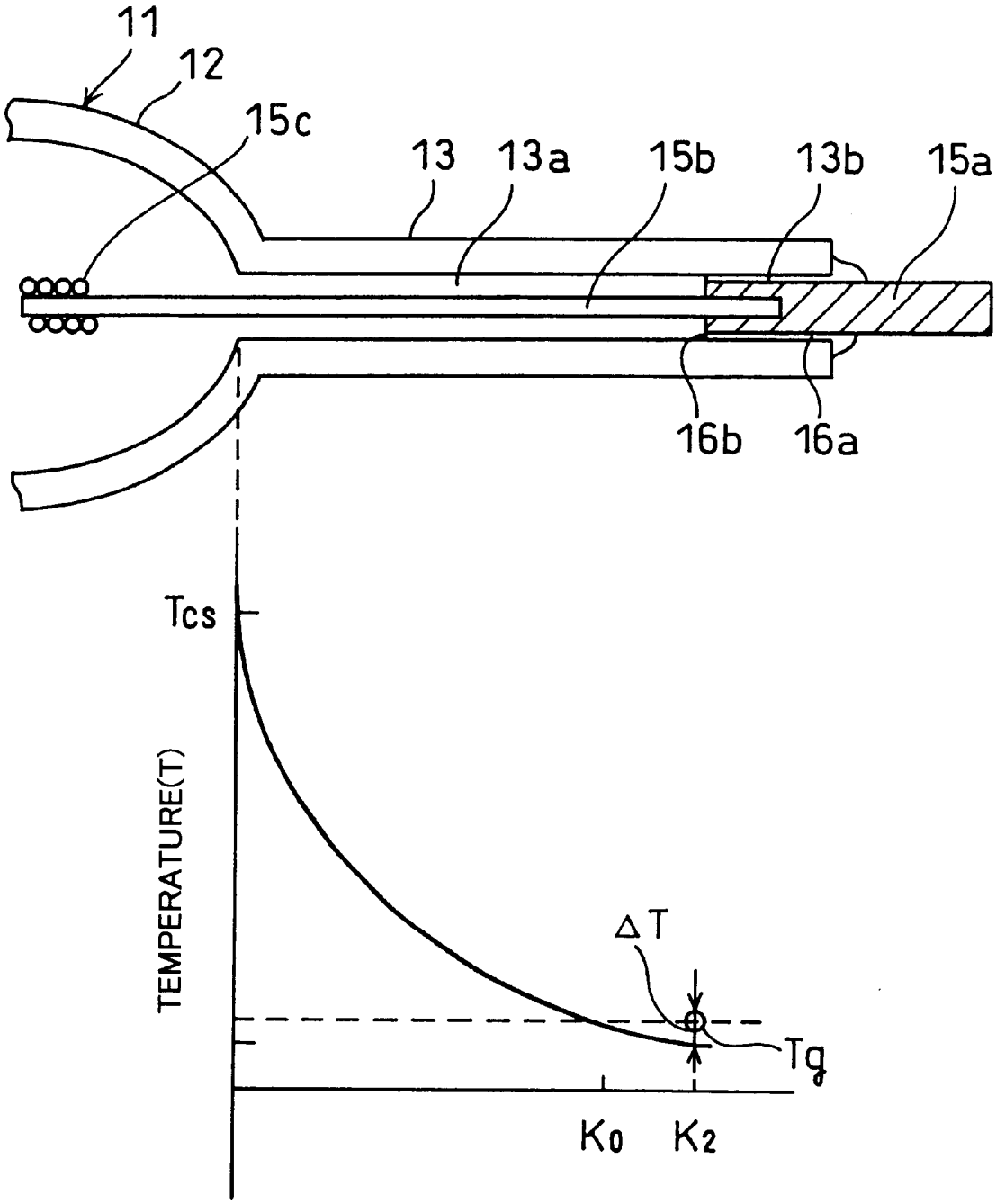
FIG. 5 shows a temperature distribution in a small-diametral portion 13 of the discharge lamp 10.

(1) The length K2 relating to the electrode member 15 is designed to prevent the temperature of a glass end 16*b* of the sealing glass 16*a* from being higher than a glass transition temperature Tg at the time of emission of the discharge lamp 10. As mentioned above, the temperature distribution at the time of emission of the discharge lamp 10 has a substantially elliptical shape. When the temperature of the joint is equal to a coolest part temperature Tcs in the large-diametral portion 12, the temperature T gradually lowers from the narrow tubular chamber 13*a* towards the opening 13*b* of the small-diametral portion 13 as shown in FIG. 5. At the position of a distance KO, the temperature T becomes equal to the glass transition temperature Tg of the sealing glass 16*a*. The temperature T further decreases and becomes lower than the glass transition temperature Tg of the sealing glass 16*a* by ΔT at the position of the glass end 16*b*. Namely the length K2 relating to the electrode member 15 is set to cause the temperature T of the glass end 16*b* of the sealing glass 16*a* to be not greater than the glass transition temperature Tg.

At the time of emission of the discharge lamp 10, the temperature of the glass end 16*b* of the sealing glass 16*a* does not become higher than the glass transition temperature Tg but is kept lower than the glass transition temperature Tg by at least ΔT. This arrangement protects the sealing glass 16*a* from exposure to the temperatures of higher than the glass transition temperature Tg and thereby prevents the spectral components of the discharge lamp 10 from being contaminated with the spectral components of the constituents that are originally included in the sealing glass 16*a* and freed from the sealing glass 16*a* due to the high temperatures. This arrangement thus prevents adverse effects on the discharge properties of the discharge lamp 10. Since the length of the small-diametral portion 13 is increased with an increase in length of the electrode member 15, it is preferable to increase the thickness of the small-diametral portion 13 when the enhanced mechanical strength is required for the small-diametral portion 13.

(2) Referring back to FIG. 4, both ends of the large-diametral portion 12 form semispherical curved surfaces 12*c* about the inner ends of the electrode elements 15*c*. A cylindrical part 12*d* is continuous with the curved surfaces 12*c* and has a diameter D1 (=2K1). This shape is ascribed to the following reasons.

Heat of the electrode element 15*c* evolved due to the arc discharge raises the temperature in the arc tube 11. The temperature distribution has a substantially semispherical shape about the end of the electrode element 15*c* in the curved surface 12*c*. When the temperature of the wall face of the curved surface 12*c* exceeds 1250° C., alumina in the curved surface 12*c* is softened to lower the durability. When an part of area in the curved surface 12*c* is a low temperature area, on the contrary, the telumine scent substances in the low temperature area are kept in the liquid state and does not cause emission, thereby lowering the efficiency of emission.

By taking into account these phenomena, the curved surface 12*c* and the cylindrical part 12*d* of the large-diametral portion 12 are designed to have the configuration corresponding to the temperature distribution of the electric arc and hold the temperatures approximately equal to 1250° C., which is the limit heat-resistant temperature of alumina in the arc tube 11. This arrangement prevents the thermal deterioration of the arc tube 11 and improves the life of the arc tube, while eliminating the low temperature area to enhance the efficiency of emission.

At the time of emission of the discharge 1 amp 10, the pressure in the hollow chamber 12*a* increases and a large stress is applied to the large-diametral portion 12C. Since the large-diametral portion 12 of the arc tube 11 has the curved surfaces 12*c*, this configuration enables dispersion of the stress and prevents the stress from being locally condensed, thus improving the durability of the discharge lamp 10.

Figure 6:
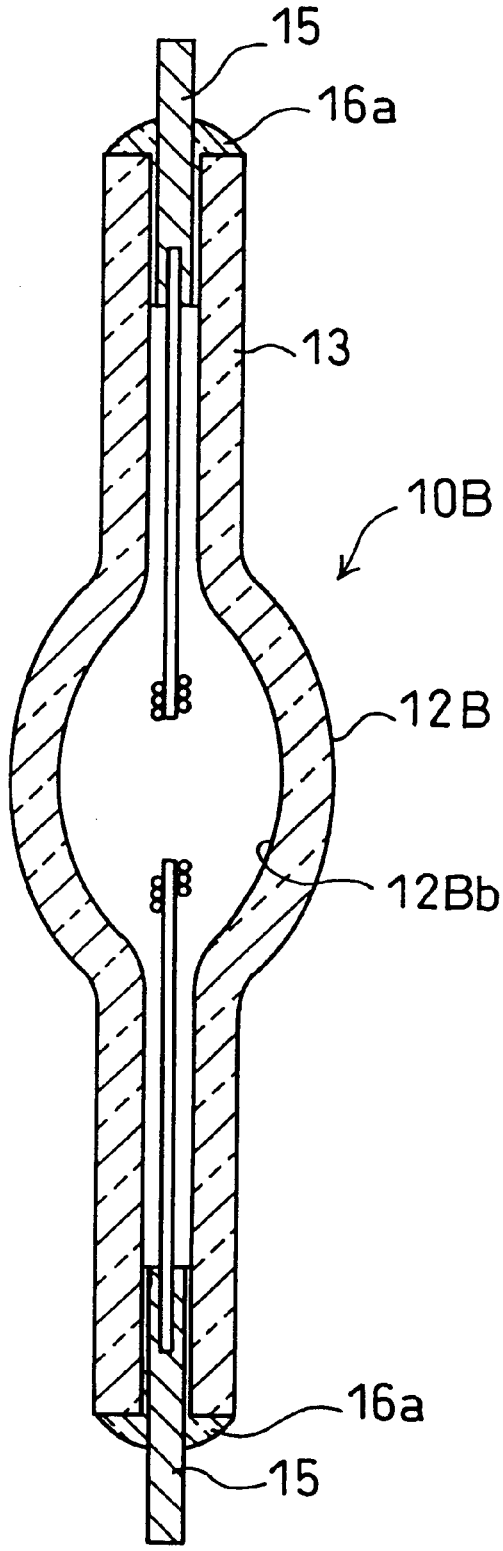
FIG. 6 is a sectional view illustrating another discharge lamp 10B in another embodiment according to the present invention.
Figure 7:
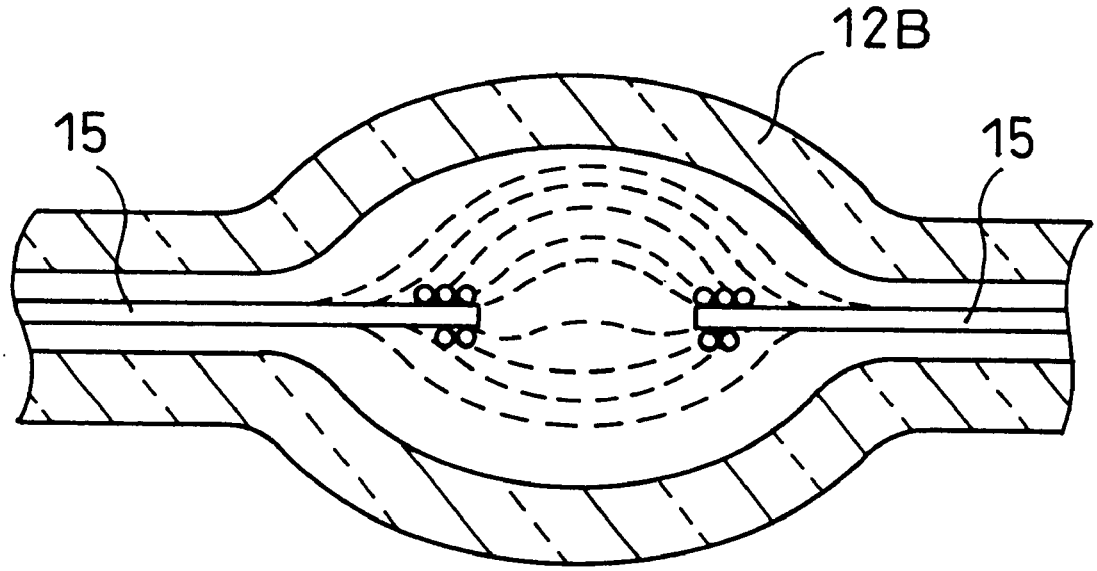
FIG. 7 shows a temperature distribution at the time of emission of the discharge lamp 10B.

(3) FIG. 6 is a sectional view illustrating another discharge lamp 10B in another embodiment according to the present invention. The discharge lamp 10B has a rugby ball-like large-diametral portion 12B. This shape of the large-diametral portion 12B is ascribed to the following reason. When the discharge lamp 10B is arranged in a horizontal orientation and radiated, the arc may be bent upward to cause a corresponding temperature distribution shown by the broken lines in FIG. 7. In this case, if the inner wall face of the large-diametral portion 12B does not fit the shape of the electric arc, a partial temperature unevenness occurs on the inner wall face of the large-diametral portion 12B. The large-diametral portion 12B is accordingly designed to have the rugby ball-like shape that fits the temperature distribution due to the arc discharge.

Figure 8:
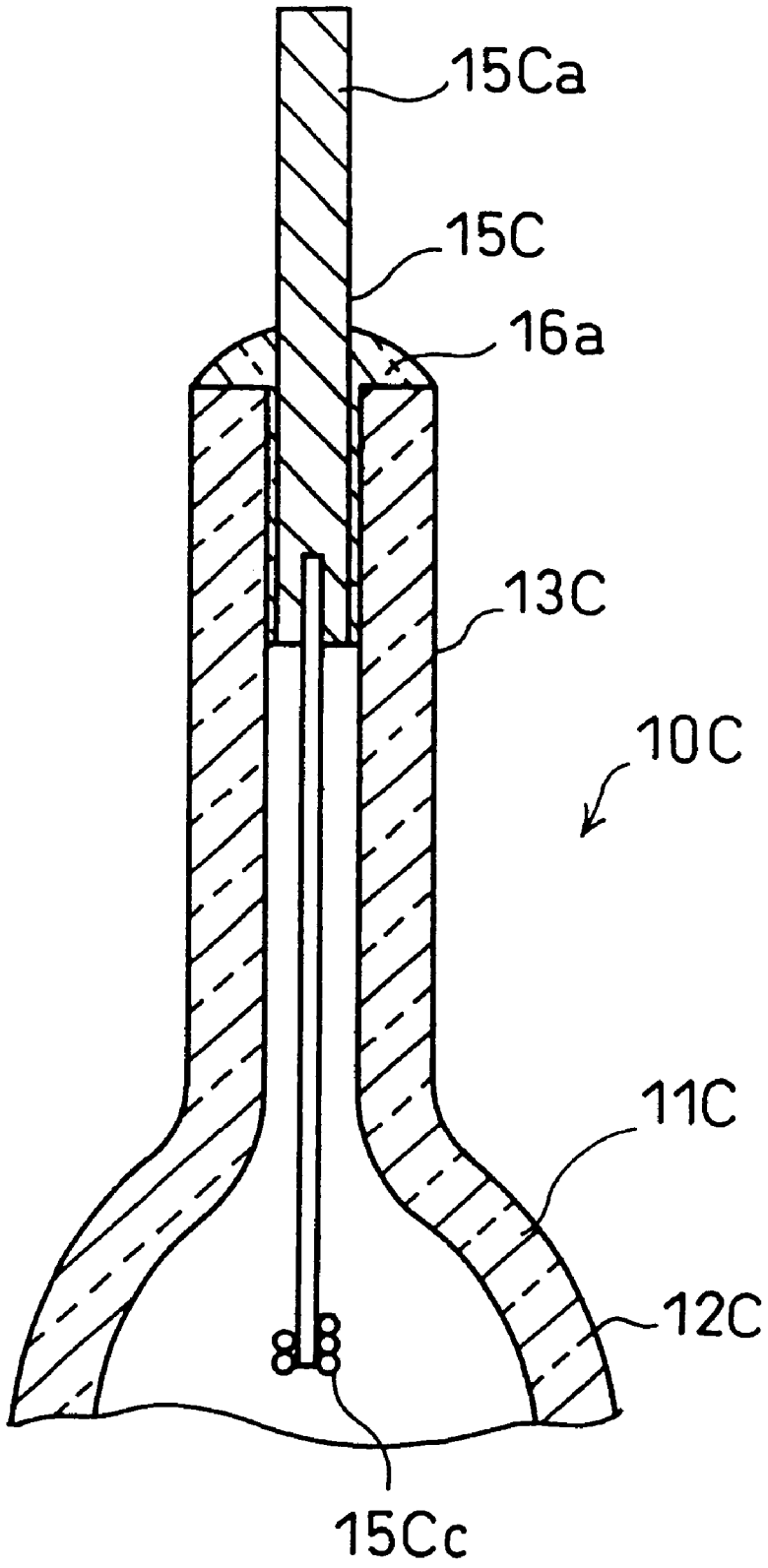
FIG. 8 is a sectional view illustrating an end portion of another discharge lamp 10C in still another embodiment according to the present invention.

(4) FIG. 8 is a sectional view illustrating an end portion of another discharge lamp 10C in still another embodiment according to the present invention. An arc tube 11C of the discharge lamp 10C is mainly made of a translucent material having a thermal conductivity 0.11 cal/cm·s·° K, which is greater than the thermal conductivity 0.08 cal/cm·s·° K of the conventional $Al_2O_3$ material. Such a translucent material is obtained, for example, by pyrolysis of an aluminum salt. The method of preparing $Al_2O_3$ by pyrolysis of an aluminum salt is discussed in detail in JAPANESE PATENT LAID-OPEN GAZETTE No. 3-174454 and is thereby not specifically described here. An electrode member 15C has a sealing base element 15Ca having a large length of protrusion to the outside in order to enhance dissipation of heat conducted from a small-diametral portion 13C of the arc tube 11C.

The increased thermal conductivity of the arc tube 11C and the long protrusion of the sealing base element 15Ca of the electrode member 15C are ascribed to the following reason. When arc discharge occurs between electrode elements 15Cc in the discharge lamp 10C, the temperature in the arc tube 11C increases. The heat is conducted from the large-diametral portion 12C to the small-diametral portions 13C of the arc tube 11C. The heat is further conducted from the small-diametral portions 13C to the electrode members 15C and released from the electrode members 15C. In the case where the arc tube 11C has a large thermal conductivity, the heat of the large-diametral portion 12C is quickly conducted to the small-diametral portions 13C and thereby raises the temperature in the space of the small-diametral portion 13C, which often forms a coolest part. This arrangement enables the luminescent substances, which often stay in the coolest part, to be contributed to the emission and thereby enhances the efficiency of emission.

Table 1 shows the results of an emission test with regard to the discharge lamp 10C having the large thermal conductivity. The following conditions were adopted in the test of the discharge lamp 10C. The total length of the arc tube 11C was 50 mm; the distance between the electrode elements 15Cc was set equal to 14 mm; and the luminescent substances included 4 mg of $DyI_3$—CsI (85:15% by weight), 4 mg of Ti, and 2.5 mg of NaI. Crystallized glass $Dy_2C_3$—$SiC_2$—$Al_2O_3$ that is softened at the glass transition temperature Tg equal to 800° C. was applied for the sealing glass 16*a*. The electrode members 15C of the discharge lamp 10C were connected to a stable power source having a fixed voltage of 100 V via external lead wires. A discharge lamp using the conventional $Al_2O_3$ material having the thermal conductivity 0.08 cal/cm·s·° K was also tested as a comparative example.

TABLE 1

| | Thermal conductivity (cal/cm · s · ° C.) | Lamp voltage (V) | Lamp power (W) | Total flux (lm) | Efficiency (lm/V) | Color temperature (K.) | Mean color rendering property (Ra) |
|---|---|---|---|---|---|---|---|
| Example | 0.11 | 115.0 | 153 | 14.501 | 94.8 | 3937 | 95.2 |
| Comparative example | 0.08 | 82.9 | 134 | 11.852 | 88.2 | 3763 | 88.6 |

The efficiency of emission in Table 1 was evaluated as the total flux (1 m)/power (W) As clearly understood from Table 1, the increase in the conductivity of the arc tube 11C improved the efficiency of emission from 88.2 to 94.8. The color temperature became close to a target value, 4000K. The mean color rendering property, which is a relative evaluation value to the sunlight set equal to 100, approached to a target value, 100.

Figure 9:
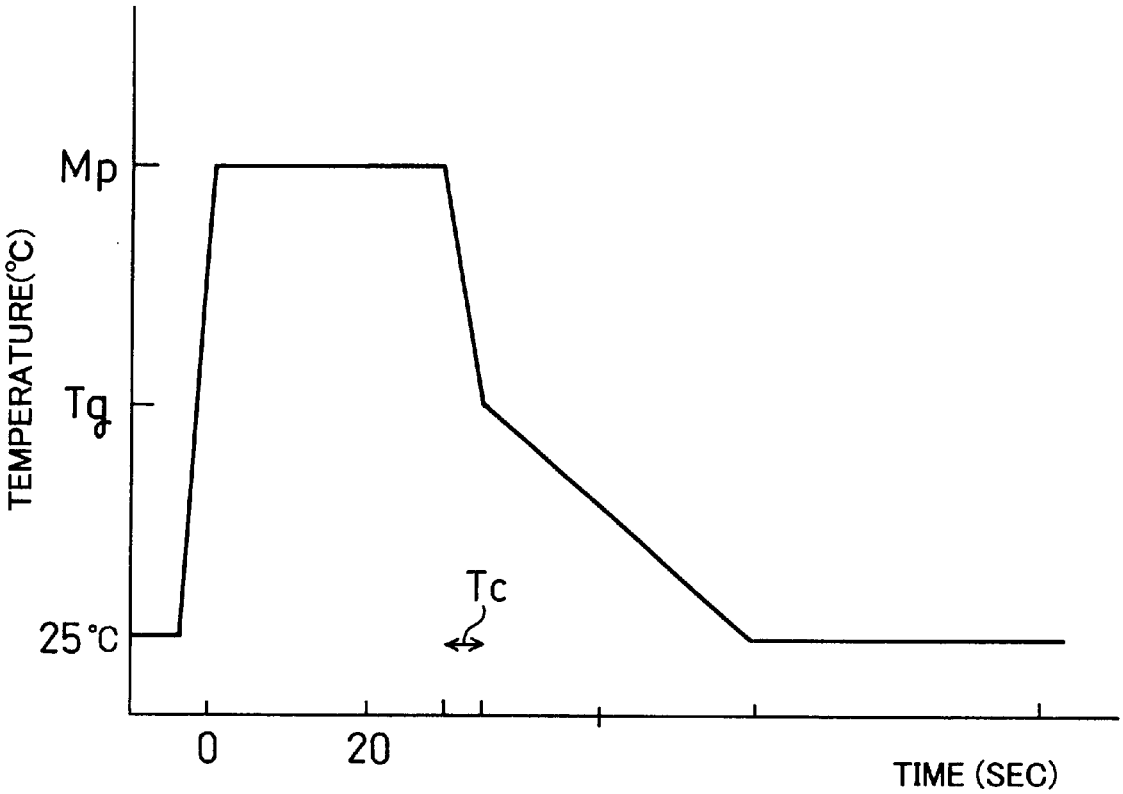
FIG. 9 shows a process of sealing an opening 13*b* of an arc tube 11 with a sealing glass 16*a;*

(5) In the process of sealing the opening 13*b* of the arc tube 11 shown in FIG. 1, the fused sealing glass 16*a* is rapidly cooled down to be in an amorphous state. The sealing glass 16*a* is heated and fused with infrared radiation to seal the gap between the sealing base element 15*a* of the electrode member 15 and the small-diametral portion 13. FIG. 9 is a timing chart showing a process of sealing the opening 13*b* of the arc tube 11 with the sealing glass 16*a*. As shown in FIG. 9, the process irradiates the sealing glass 16*a* with infrared emission to heat the sealing glass 16*a* from ordinary temperature to a melting point (Mp) of the sealing glass 16*a*, and then rapidly cools the fused sealing glass 16*a* down to the glass transition temperature Tg in about 5 seconds. This process prevents re-crystallization of at least a sealing part of the sealing glass 16*a* but changes the part to an amorphous state. Even when the arc tube 11 is exposed to a heat cycle at the time of emission, the amorphous state of the sealing glass 16*a* prevents the adhesion strength of the sealing glass 16*a* from being lowered and maintains the sufficient sealing ability.

Figure 10:
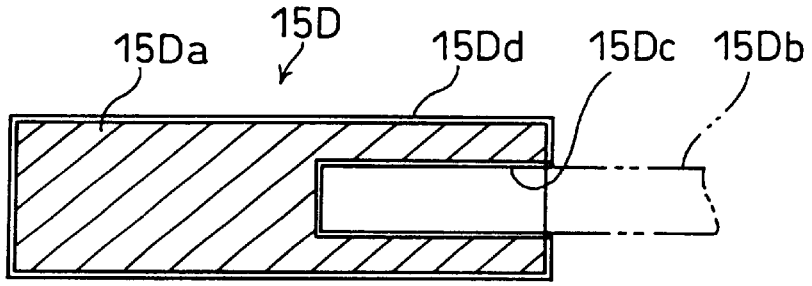
FIG. 10 is an enlarged sectional view illustrating a sealing base element 15Da, which is part of an electrode member 15D of a discharge lamp.
Figure 11:
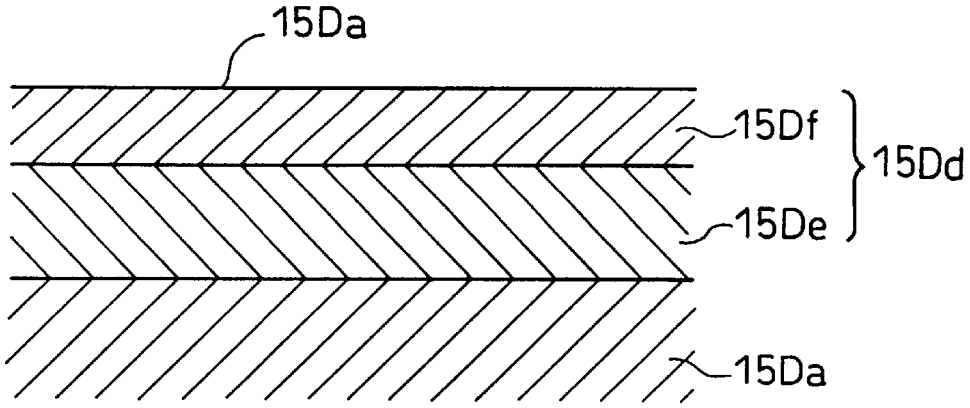
FIG. 11 is an enlarged sectional view showing the surface of the sealing base element 15Da.

FIG. 10 is an enlarged sectional view illustrating a sealing base element 15Da, which is part of an electrode member 15D of a discharge lamp. FIG. 11 is an enlarged sectional view showing the surface of the sealing base element 15Da. Referring to FIG. 10, the sealing base element 15Da is a columnar member mainly made of a Nb—Zr alloy and has an insertion aperture 15Dc formed on one end thereof. A lead element 15Db is fitted in and fixed by the insertion aperture 15Dc. A film layer 15Dd is formed around the circumference of the sealing base element 15Da. As shown in FIG. 11, the film layer 15Dd is formed by laying a thin film layer 15Df upon a buffer layer l5De. The thin film layer 15Df is made of W having the resistance to halide and has the thickness of 2 $\mu$m. The buffer layer 15De has durability against the heat cycle (ordinary temperature to 1000° C.) with regard to the joint of the sealing base element 15Da with the thin film layer 15Df. The buffer layer 15De has the thickness of about 3 $\mu$m. Part of the buffer layer 15De closer to the sealing base element 15Da contains a greater ratio of the Nb—sr alloy, and another part of the buffer layer 15De closer to the thin film layer 15Df contains a greater ratio of W. Namely the ratio of W in the buffer layer 15De gradually increases from th e part near to the sealing base element 15Da to the part near to the thin film layer 15Df.

Since the buffer layer 15De and the thin film layer 15Df are laid upon the sealing base element 15Da, and the thin film layer 15Df having the resistance to halide is formed as the outer-most layer of the sealing base element 15Da, this configuration has the corrosion resistance to the halogen-containing luminescent substances and thereby the excellent durability.

The buffer layer 15De has the composition in which the concentration of W gradually increases. The inner side of the buffer layer 15De accordingly has a thermal expansion coefficient close to that of the sealing base element 15Da, whereas the outer side of the buffer layer 15De has a thermal expansion coefficient close to that of the thin film layer 15Df. When the discharge lamp 10D is exposed to the heat cycle from the ordinary temperature to 1000° C., this configuration reduces the stresses on the respective interfaces and effectively prevents the thin film layer 15Df from coming off the sealing base element 15Da.

It is preferable that the thin film layer 15Df and the buffer layer 15De have the thicknesses that facilitate the continuous variation of the thermal expansion coefficient. For example, the thin film layer 15Df is not greater than 2 $\mu$m in thickness, and the buffer layer 15De is not greater than 3 $\mu$m in thickness. Addition of La2O3 to the sealing glass 16Df is preferable in order to enhance the adhesive strength of the thin film layer 15Df to the sealing glass 16Df.

Figure 12:
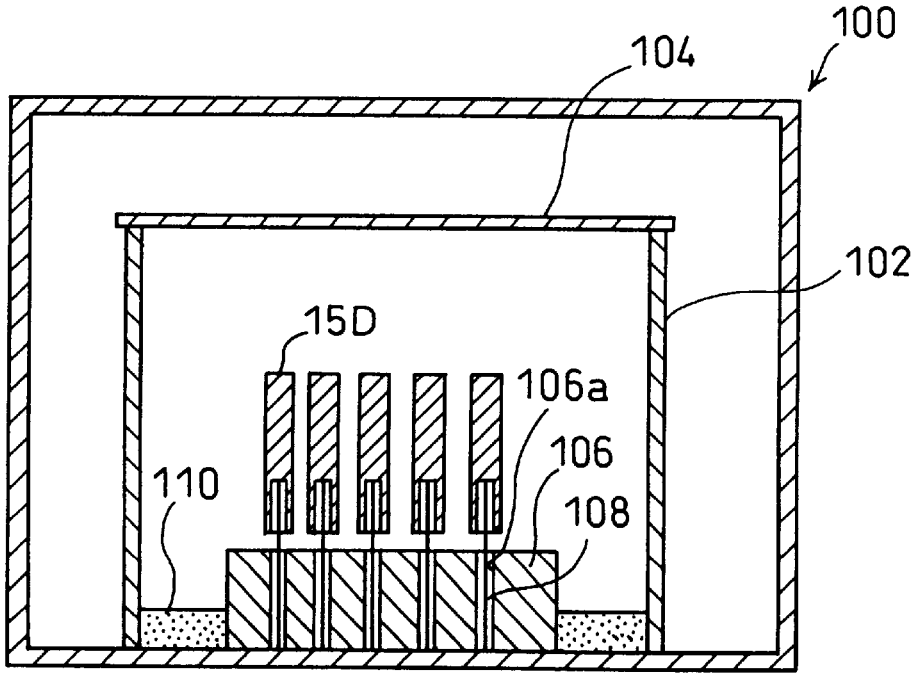
FIG. 12 is a sectional view illustrating a heating oven 100.

The following describes a thin film forming process to form the buffer layer 15De and the thin film layer 15Df on the surface of the sealing base element 15Da. A heating oven 100 shown in FIG. 12 is applied for the thin film forming process. FIG. 12 is a sectional view illustrating the heating oven 100. The heating oven 100 has a space for accommodating a sealing vessel 102 therein. The sealing vessel 102 is closed in a sealing state by a cover 104. A support table 106 having a plurality of support holes 106*a* is installed in a bottom portion of the sealing vessel 102. A layer of powdery tungsten 110, which is the material for forming the thin film layer 15Df and the buffer layer 15De, is spread over the bottom of the sealing vessel 102.

The thin film forming process proceeds in the following manner with the heating oven 100. While the cover 104 is open, support pins 108 are inserted into the support holes 106*a* formed in the support table 106. The upper portions of the support pins 108 are fitted into the insertion apertures 15Dc of the sealing base elements 15Da, so that the sealing base elements 15Da are supported on the support table 106 via the support pins 108. The sealing vessel 102 is evacuated with a non-illustrated vacuum pump to have an atmosphere of $10^{-6}$ Torr in degree of vacuum. The atmosphere in the heating oven 100 is subsequently heated to the temperature of not lower than 1500° C. and kept at the temperature for two hours.

This heat treatment vaporizes part of the W powder in the powdery tungsten layer 110, and causes the Nb—Zr alloy of the sealing base element 15Da to be impregnated with the W vapor. The temperature of the atmosphere in the heating oven 100 is gradually decreased from 1500° C. to 1400° C. in six hours, so that the thin film layer 15Df is formed.

The above heat treatment causes the buffer layer 10De including dispersion of W to be formed on the surface of the sealing base element 15Da and the thin film layer 15Df having the continuous variation in W concentration to be further formed on the thin film layer 15Df. The buffer layer 15De and the thin film layer 15Df are densely formed on the surface of the sealing base element 15Da including the insertion aperture 15Dc.

The sealing base element 15Da is made of not a Nb simple body of 100% by weight but a Nb alloy, because of the following reason. Nb of 100% by weight re-crystallizes in the high temperature range of not lower than 1400° C. and lowers the mechanical strength when applied for the sealing base element 15Da. The Nb—Zr alloy is accordingly applied for the sealing base element 15Da, in order to prevent re-crystallization in the course of the heat treatment at the temperatures of not lower than 1400° C.

Prior to the exposure of the sealing base element 15Da to the atmosphere of W vapor, the pre-treatment may expose the sealing base element 15Da to an atmosphere of Nb vapor or an atmosphere of Nb—Zr mixed vapor. Such pre-treatment enhances the adhesion of the Nb—Zr component of the sealing base element 15Da to the W component of the thin film layer 15Df.

Figure 13:
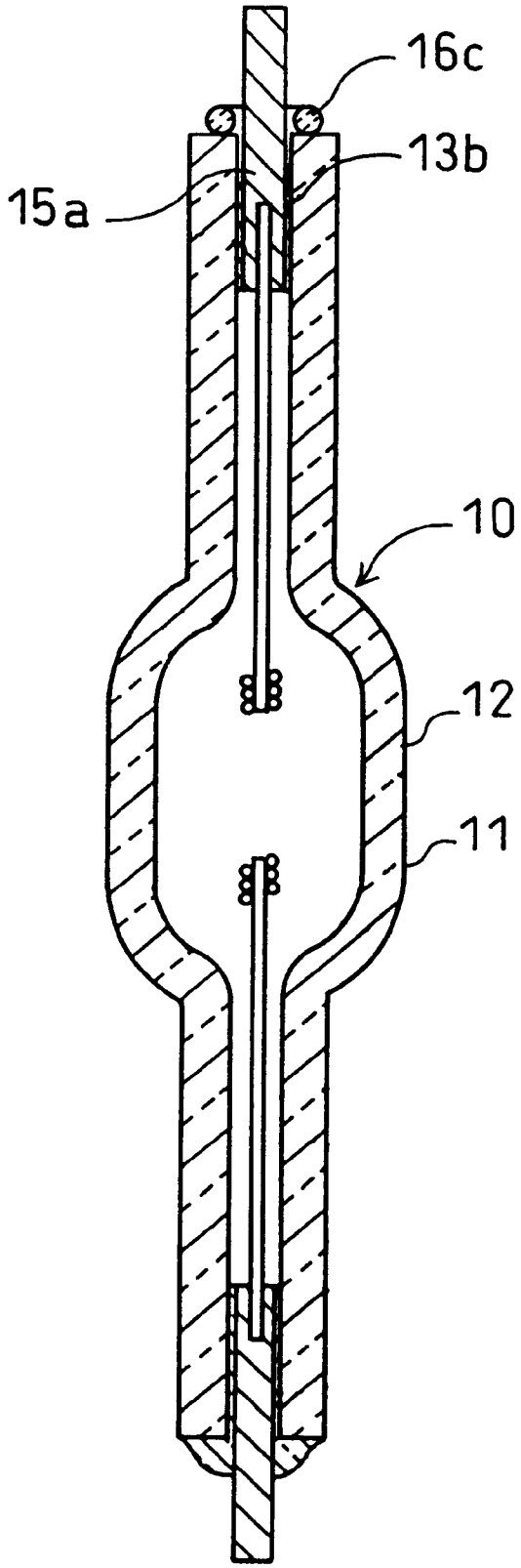
FIG. 13 is a sectional view showing the state before the discharge lamp 10 is sealed.

The arrangement discussed below shortens the processing time of the sealing process. FIG. 13 is a sectional view showing the state before the discharge lamp 10 is sealed. The opening 13*b* of the arc tube 11 is sealed by heating and fusing a glass ring 16*c*. The glass ring 16*c* contains an infrared-absorbing substance. Typical examples of the infrared-absorbing substance include oxides of rare earth elements, such as $CeO_2$ (pale yellow), $Sm_2O_3$ (pale pink), $HoO_3$ (pale pink), $DY_2O_3$ (pale yellow), $Er_2O_3$ (pink), and $Nd_2O_3$ (bluish purple). The colored glass ring 16*c* is prepared by mixing one of the oxides of rare earth elements with the $Al_2O_3$—$SiO_2$ glass.

FIG. 14 shows the compositions and colors of various glass rings 16*c* and the results of the sealing process with the glass rings 16*c*. The condition of the sealing process applied here was that the glass ring 16*c* irradiated with the infrared emission was kept at the temperature of 1500° C. for 30 seconds. The results of the sealing process were evaluated as the flow length of the fused glass ring 16*c* flown into the gap between the arc tube 11 and the sealing base element 15*a*. A glass ring containing Y2O3 was also evaluated as a comparative example. While the prior art composition required the heating time of about one minute for sealing, the compositions of this embodiment shortened the required heating time to about 30 seconds. Mixing the infrared-absorbing substance with the primary constituent of the glass ring 16*c* enables the infrared radiation to be condensed on the glass ring 16*c* and rapidly increase the temperature of the glass ring 16*c*, thereby ensuring completion of the sealing process within a short time period. The shortened heating time restrains a temperature rise in the arc tube 11 and prevents the luminescent substances from flying out of the arc tube 11.

The infrared-absorbing substance may be mixed with a coating material, which is applied onto the surface of the glass ring 16*c*, instead of being directly mixed with the primary constituent of the glass ring 16*c*.

Figure 31:
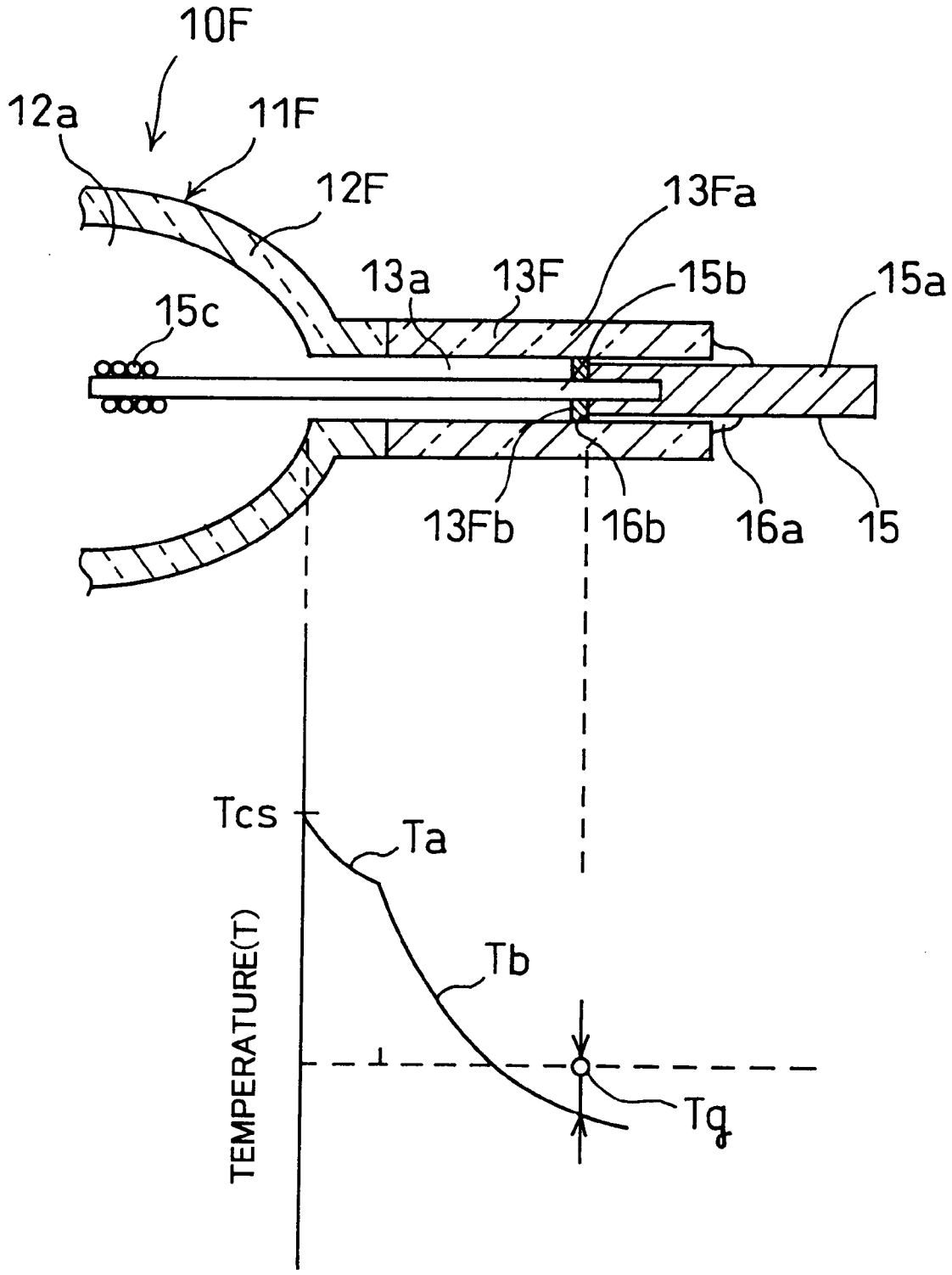
FIG. 31 shows a temperature distribution of an end portion of another discharge lamp 01F in another embodiment according to the present invention.

FIG. 31 shows the structure of another discharge lamp 10F in another embodiment according to the present invention and its temperature distribution. The discharge lamp 10F has a large-diametral portion 12F and a pair of small-diametral portions 13F. The small-diametral portion 13F has a low heat conduction part 13Fa, which is made of a specific material having a lower thermal conductivity than that of the large-diametral portion 12F. The sealing base element 15*a* of the electrode member 15 is supported on the low heat conduction part 13Fa via the sealing glass 16*a*. The low heat conduction part 13Fa may be prepared by sticking the specific material with the large-diametral portion or alternatively casting the specific material in the casting process.

Formation of the low heat conduction part 13Fa in the small-diametral portion 13F is ascribed to the following reason. Application of the translucent material having a large thermal conductivity for the large-diametral portion 12F heightens the coolest part temperature Tcs in the large-diametral portion 12F and improves the emission efficiency of the discharge lamp 10F as discussed previously. Although the rise of the coolest part temperature Tcs leads to a temperature rise of the glass end 16*b* of the sealing glass 16*a*, the low heat conduction part 13Fa solves this problem.

In the temperature distribution of FIG. 31, a curve Ta represents a temperature variation in the end of the large-diametral portion 12F and part of the small-diametral portion 13F extended from the large-diametral portion 12F. A curve Tb represents a temperature variation in the low heat conduction part 13Fa of the small-diametral portion 13F. The temperature gradient of the curve Tb is greater than the temperature gradient of the curve Ta. Even when the coolest part temperature Tcs rises during the emission of the discharge lamp 10F, the large temperature gradient of the curve Tb readily causes the temperature on the glass end 16*b* of the sealing glass 16*a* to be lower than the glass transition temperature Tg. The low heat conduction part 13Fa reduces the temperature of the sealing glass 16*a* even under the condition of the high emission temperature in the discharge lamp 10F. A ring-shaped heat-insulator 13Fb containing, for example, $Al_2O_3$ may be interposed between the narrow tubular chamber 13*a* and the glass end 16*b*, in order to prevent the temperature rise of the glass end 16*b* of the sealing glass 16*a* due to the conducted heat, in which the large-diametral portion 12F is conducted to the narrow tubular chamber 13*a* of the small-diametral portion 13F.

Figure 15:
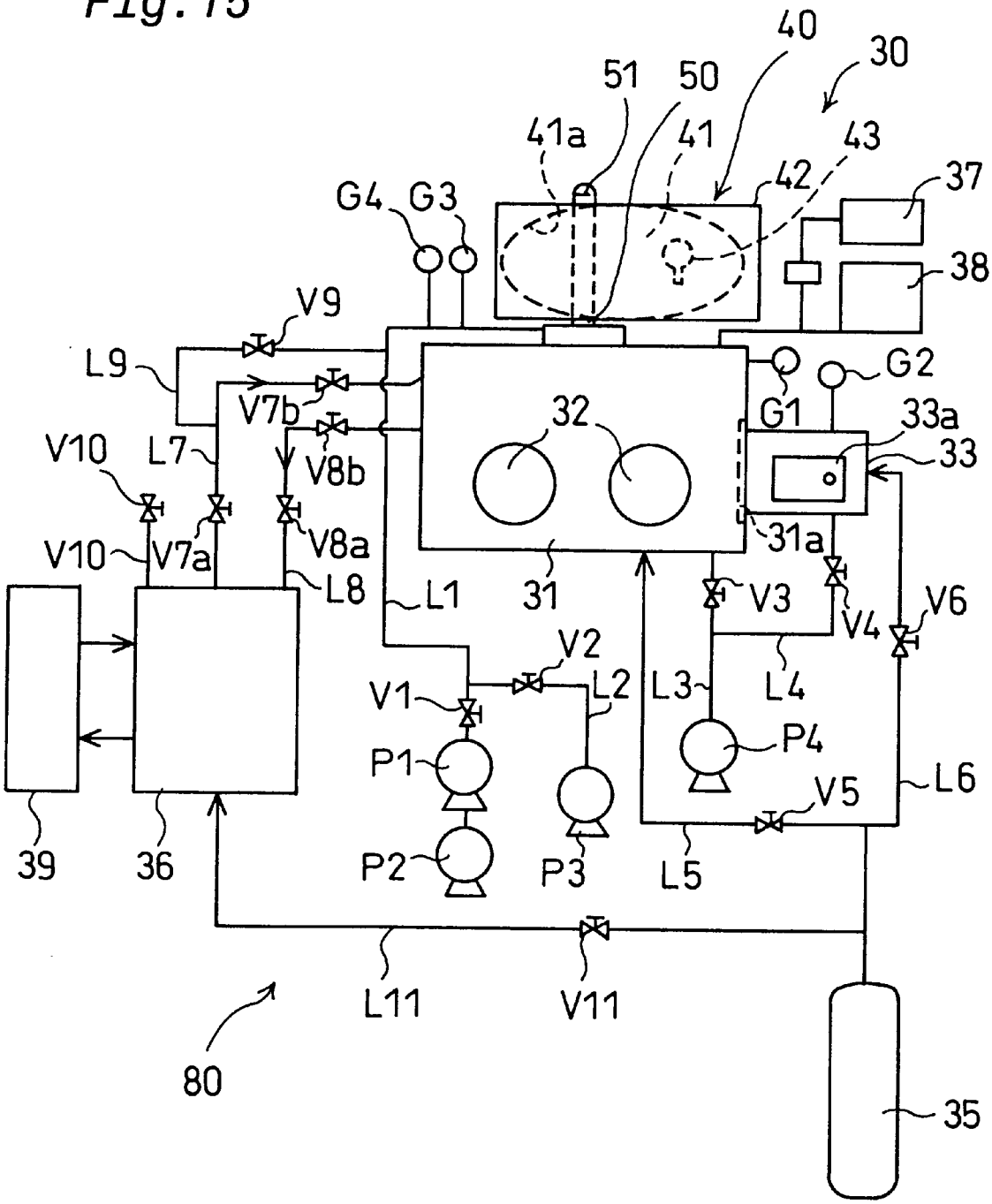
FIG. 15 schematically illustrates a discharge lamp sealing apparatus 30 for sealing the end of the arc tube 11.

The following describes a process of sealing the end of the arc tube 11. FIG. 15 schematically illustrates a discharge lamp sealing apparatus 30 for sealing the end of the arc tube 11, and FIG. 16 is an enlarged sectional view illustrating a main part of the discharge lamp sealing apparatus 30 shown in FIG. 15.

The discharge lamp sealing apparatus 30 includes an operation box 31, a pass box 33, a heating unit 40, a feeding mechanism 50, and a pumping mechanism 80.

The operation box 31 has a pair of operation gloves 32,32 on the front face thereof, which receive the hands of the user therein. The user can carry out the required operations in an air-tight manner with the pair of operation gloves 32,32. The pass box 33 is located adjacent to the operation box 31. The pass box 33 is continuous with the operation box 31 across a door 31*a*. The user can feed a variety of supplies delivered into the pass box 33 with the pair of operation gloves 32,32. The pass box 33 has a door 33*a* that is open to the outside. The user can deliver a variety of supplies and materials into the pass box 33 while the door 33*a* is open.

Figure 16:
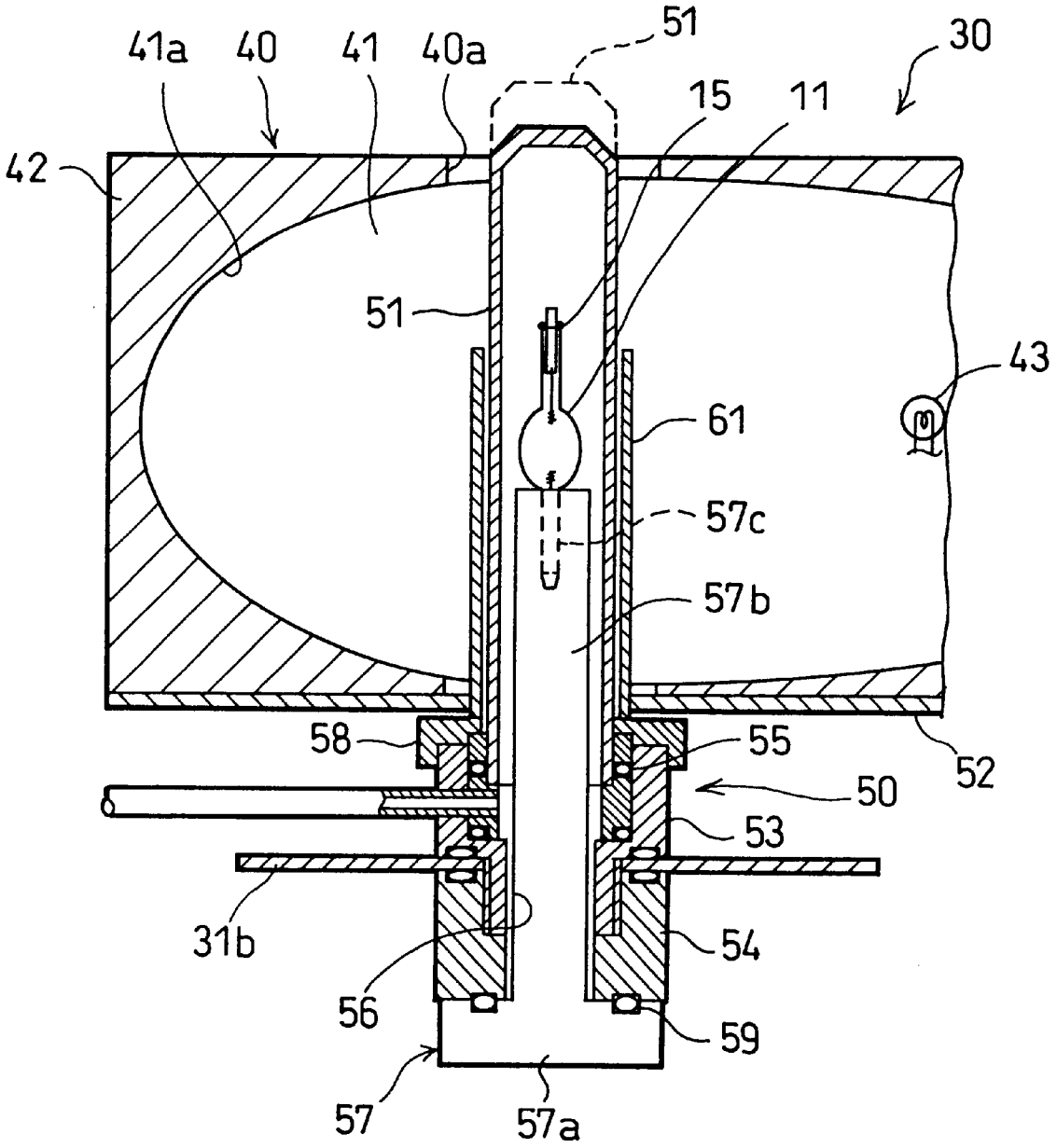
FIG. 16 is an enlarged sectional view illustrating a main part of the discharge lamp sealing apparatus 30 shown in FIG. 15.

The heating unit 40 is disposed above the operation box 31 across a support plate 52 as shown in FIG. 16. The heating unit 40 includes a casing 42 for defining a heating chamber 41 and an infrared lamp 43 located in the heating chamber 41. A reflecting plane 41*a* having the function of reflecting the infrared radiation is formed to face the heating chamber 41. The reflecting plane 41a is a concave mirror that reflects the infrared radiation from the infrared lamp 43 and condenses the reflected infrared radiation to a light condensing area. The reflecting plane 41*a* is obtained by covering the casing 42 with a metal like platinum, gold, or nickel according to the method of spray coating or sputtering. The reflecting plane 41*a* is arranged to be cooled down by a non-illustrated cooling unit.

The feeding mechanism 50 is disposed below the heating unit 40. The feeding mechanism 50 moves the arc tube 11 from the operation box 31 and exposes the arc tube 11 in an air-tight manner to the light condensing area in the heating chamber 41. The feeding mechanism 50 includes a feeding conduit 51 mainly made of quartz glass, an upper fixture 53 that is disposed on the top face of the operation box 31 to support the feeding conduit 51, a lower fixture 54 that is screwed to the upper fixture 53 to clamp a top plate 31*b* of the operation box 31, a sealing member 55 that is interposed between the upper fixture 53 and the feeding conduit 51, and a nut 58 that is jammed to seal the gap between the upper fixture 53 and the feeding conduit 51 with the sealing member 55.

A feed hole 56 is formed to run through the lower fixture 54 and the upper fixture 53, and a support jig 57 is inserted into and removed from the feed hole 56. The support jig 57 includes a flange 57*a* that is in contact with the bottom face of the lower fixture 54 via an O ring 59 and a support 57*b* that is extended upright from the flange 57*a*. A support aperture 57*c* is formed in the upper end of the support 57*b* in order to support one end of the arc tube 11. The support jig 57 is designed to be freely lifted up and down through the feeding conduit 51. The mechanism for lifting up and down the support jig 57 may be manual, power-driven or pneumatic.

An infrared shield 61 is disposed around the feeding conduit 51. The infrared shield 61 is a tubular body that is made of Pt and reflects the infrared radiation, in order to cause the infrared radiation to enter only the upper portion of the arc tube 11. The infrared shield 61 is extended upright to a position that is a little lower than the height of the electrode member 15 of the arc tube 11.

Figure 17:
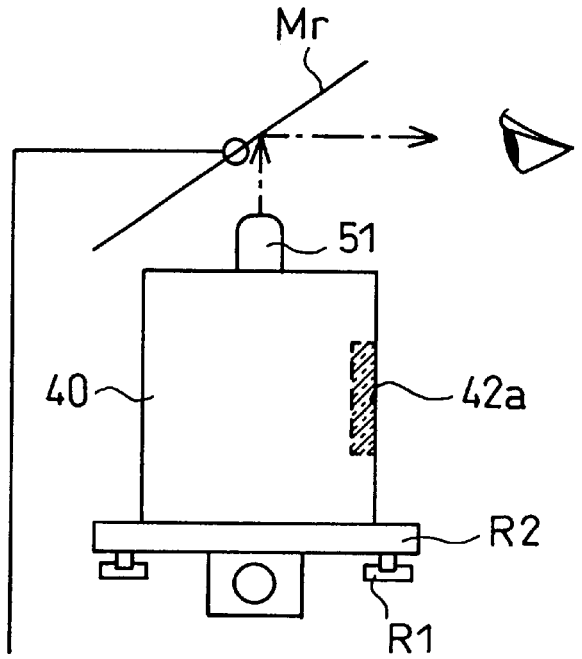
FIG. 17 is a side view schematically illustrating a heating unit 40.
Figure 18:
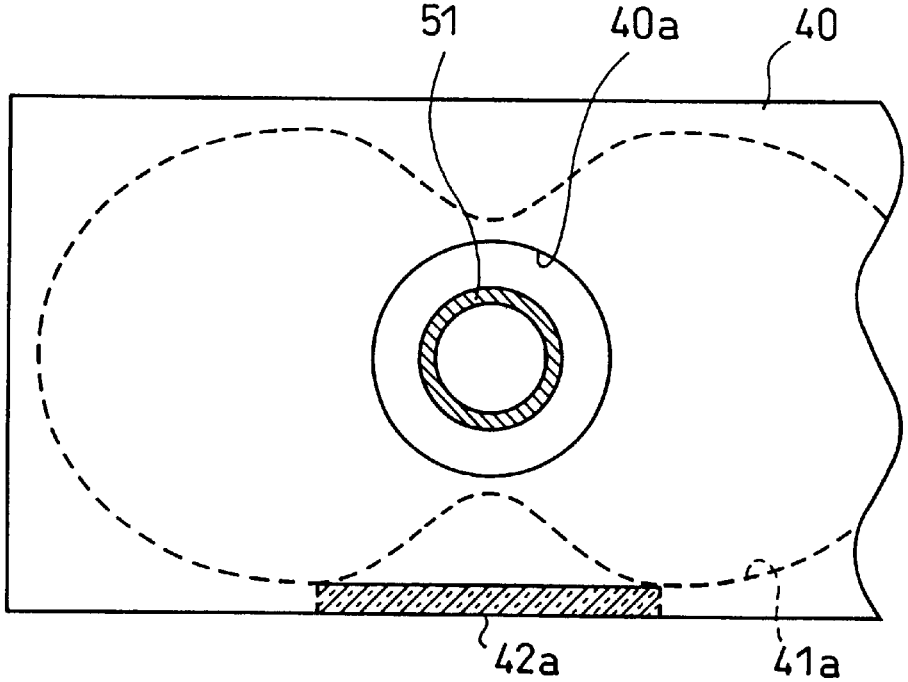
FIG. 18 is a top view illustrating the heating unit 40.

FIG. 17 is a side view schematically illustrating the heating unit 40, and FIG. 18 is a top view illustrating the heating unit 40. As shown in FIG. 17, an X-axis rail R1 and a Y-axis rail R2 are laid below the heating unit 40. The X-axis rail R1 and the Y-axis rail R2 are arranged to be perpendicular to each other on the horizontal surface and support the heating unit 40 to enable the movement thereof. The heating unit 40 is thus movable to an arbitrary position in the horizontal direction. The structure for enabling the user to observe the sealing state of the arc tube 11 located in the feeding conduit 51 includes a mirror Mr located above and on the center of the heating unit 40 and a transparent window 42*a* disposed on the side face of the heating unit 40 as shown in FIG. 18.

Referring back to FIG. 15, the pumping mechanism 80 of the discharge lamp sealing apparatus 30 includes a turbo pump P1 and rotary pumps P2, P3, and P4. The turbo pump P1 gives the high degree of vacuum ($10^{-5}$ to $10^{-7}$ Torr). The rotary pump P2 is connected to the turbo pump P1 in series to ensure the smooth operation at the start of the turbo pump P1. The rotary pumps P3 and P4 give the low degree of vacuum (about $10^{-1}$ Torr).

The turbo pump P1 is connected to the feeding conduit 51 via a piping L1 with a valve V1. The rotary pump P3 is connected to the piping L1 via a piping L2 with a valve V2. The rotary pump P4 is connected to the operation box 31 via a piping L3 with a valve V3 and further to the pass box 33 via a piping L4 with a valve V4.

The pressure in the operation box 31 is measured with a pressure gauge G1, the pressure in the pass box 33 with a pressure gauge G2, and the pressure in the feeding conduit 51 with pressure gauges G3 and G4 attached to the piping L1. The two pressure gauges G3 and G4 are used for measuring the pressure in the feeding conduit 51, in order to extend the measurable range, since the pressure in the feeding conduit 51 drastically varies. An oxygen analyzer 37 and a moisture meter 38 are attached to the operation box 31.

A gas circulation and purification unit 36 is located adjacent to the operation box 31. A cooling unit 39 is attached to the gas circulation and purification unit 36. The gas circulation and purification unit 36 is connected to the operation box 31 via a supply piping L7 with valves V7*a* and V7*b* and a return piping L8 with valves V8*a* and V8*b*.The supply piping L7 branches off to a piping L9 with a valve V9, which joins the piping L1 leading to the feeding conduit 51.

The gas circulation and purification unit 36 feeds a supply of Ar gas into the operation box 31 via the supply piping L7 and receives a returned supply of Ar gas via the return piping L8. The gas circulation and purification unit 36 removes oxygen from the returned supply of Ar gas through a catalytic reaction and makes the dew point not higher than −70° C. and the concentration of the residual oxygen not greater than 0.01 ppm in the operation box 31. This effectively prevents the deterioration of the performance of the discharge lamp.

The gas circulation and purification unit 36 is connected to a piping L10 with a valve V1 and also to a piping L11 with a valve V11. Feeding several drops of an alcohol into the gas circulation and purification unit 36 via the piping L10 reduces the concentration of the residual oxygen in the gas circulation and purification unit 36. A supply of Ar working as a cooling medium is fed from an Ar tank 35 to a molecular tube via the piping L11.

The following describes a process of sealing the arc tube 11. The process first closes the door 31*a* between the pass box 33 and the operation box 31 shown in FIG. 15 and opens the door 33*a* of the pass box 33 to be continuous with the outside. A variety of supplies and materials, that is, luminescent substances like mercury and iodide and the arc tube 11, are fed into the pass box 33 through the open door 33*a*. The arc tube 11 has one end that is sealed with the electrode member 15 having an electrode and the other end that is kept open.

The process subsequently closes the door 33*a* between the pass box 33 and the outside, opens the valve V4, reduces the pressure in the pass box 33 with the rotary pump P4, opens the valve V6, and replaces the reduced atmosphere in the pass box 33 with gaseous Ar. The process then opens the door 31*a* between the pass box 33 and the operation box 31 and feeds the variety of supplies, which have been delivered to the pass box 33, into the operation box 31 with the operation gloves 32,32. The operation box 31 is filled in advance with gaseous Ar and set at approximately one atmospheric pressure. The process subsequently closes the door 31*a* between the pass box 33 and the operation box 31.

Figure 19:
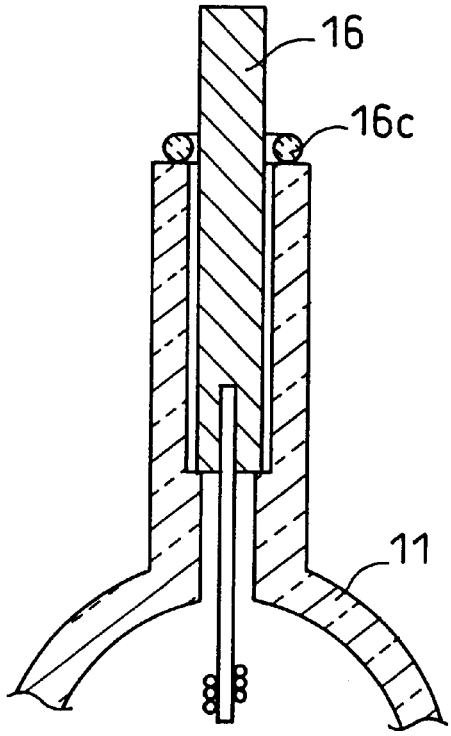
FIG. 19 is a sectional view showing the state before an opening of the arc tube 11, in which an electrode material 15 is inserted, is sealed.
Figure 20:
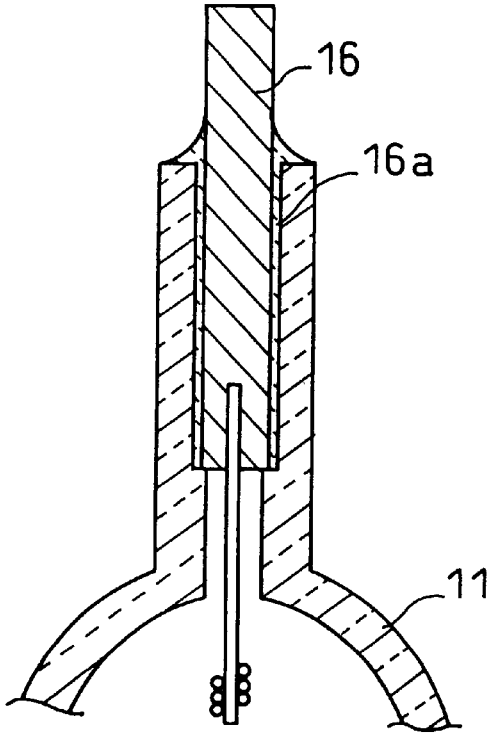
FIG. 20 is a sectional view showing the state after the opening of the arc tube 11 is sealed.

In the state that the support jig 57 of the feeding mechanism 50 shown in FIG. 16 is lifted down, the process inserts the lower end of the arc tube 11, which has been sealed with the electrode member 15, into the support aperture 57*c* of the support jig 57. This causes the arc tube 11 to be supported on the support jig 57 in the upright manner. The process subsequently injects the weighed luminescent substances into the arc tube 11 via the open upper end thereof. The process then inserts the electrode member 15 having an electrode into the open upper end of the arc tube 11 and sets the glass ring 16*c* on the circumference of the open upper end of the arc tube 11, in which the electrode member 15 is fitted, as shown in FIG. 19.

The process lifts the support jig 57 up, so as to insert the arc tube 11 supported on the support jig 57 into the feeding conduit 51 (in the state of FIG. 16). The position of the glass ring 16*c* is adjusted to the light condensing area of the infrared radiation. The detailed process of positioning the glass ring 16*c* to the light condensing area finely adjusts the position of the support jig 57 in the vertical direction based on the observation through the transparent window 42*a*, and moves the heating unit 40 on the X-axis rail R1 and the Y-axis rail R2 in the horizontal direction based on the observation with the mirror Mr as shown in FIGS. 17 and 18. This procedure enables the vertical position of the sealing glass 16*a* to be securely adjusted to the light condensing area of the infrared radiation.

Referring back to FIG. 15, the process opens the valve V1 in this state, while the valves V2 and V9 are kept closed. The gaseous Ar is removed from the feeding conduit 51 with the turbo pump P1 to the pressure of $10^{-1}$ to $10^{-7}$ Torr. The process then opens the valve V9 while the valves V1 and V2 are closed, and feeds a supply of gaseous Ar into the feeding conduit 51 to the pressure of 30 to 300 Torr.

The process turns the infrared lamp 43 on and makes the infrared radiation reflected from the reflecting plane 41*a*, so that the infrared radiation is condensed on the glass ring 16*c* to fuse the glass ring 16*c*. In this state, while the internal pressure of the arc tube 11 is kept in the range of 30 to 300 Torr, the supply of gaseous Ar increases the pressure in the feeding conduit 51 to approximately 500 Torr. This causes a pressure difference between the inside and the outside of the arc tube 11. The pressure difference enables the fused glass ring 16*c* to flow into the gap between the electrode member 15 and the arc tube 11. The process stops heating when the flow of fused glass reaches a predetermined position, based on the observation with naked eyes. This arrangement enables the gap between the opening of the arc tube 11 and the electrode member 15 to be sealed with the sealing glass 16*a*. The flow length of the fused glass may be measured automatically with a sensor, instead of being observed with naked eyes.

In this sealing process, the infrared shield 61 disposed around the feeding conduit 51 causes only the periphery of the sealing glass 16*a* to be heated, while protecting the residual part of the arc tube 11 from heat, this structure does not cause an unfavorable temperature rise in the arc tube 11 and prevents the luminescent substances from flying out of the arc tube 11.

Since the fused sealing glass 16*a* is exposed to the pressure difference between the inside and the outside of the arc tube 11, when flowing into the gap between the electrode member 15 and the opening of the arc tube 11. The pressure difference enables the fused sealing glass 11 to be smoothly flown into even a very narrow gap. The flow length of the sealing glass 16*a* is readily regulated by adjusting the pressure difference.

As shown in FIGS. 16 and 18, an opening 40*a* is formed in the upper face of the heating unit 40 in order to receive the upper end of the feeding conduit 51. The upper end of the feeding conduit 51 is projected from the opening 40*a*. It is preferable that the feeding conduit 51 has the length that is projectable from the opening 40*a*. When the light condensing part of the feeding conduit 51 is stained, the user can cut the lower end of the feeding conduit 51 to shorten the whole length of the feeding conduit 51. This enables the stained part of the feeding conduit 51 to be shifted from the light condensing area and favorably avoids frequent replacement with a new feeding conduit 51.

Figure 21:
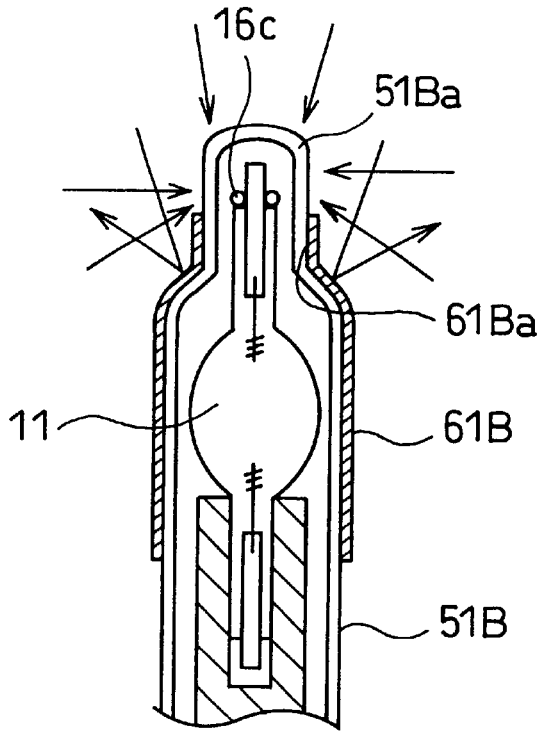
FIG. 21 is a sectional view illustrating another feeding conduit 51B with an infrared shield 61B in another embodiment according to the present invention.

FIG. 21 is a sectional view illustrating another feeding conduit 51B in another embodiment according to the present invention. An upper end portion of the feeding conduit 51B forms a narrow tubular part 51Ba as shown in FIG. 21 An infrared shield 61B is designed to set on an upper portion of the feeding conduit 51B. The infrared shield 61B has a narrow diametral portion 61Ba, in which the narrow tubular part 51Ba is fitted. In the sealing process using the infrared shield 61B, since the narrow tubular portion 61Ba of the infrared shield 61B is closer to the glass ring 16*c* set on the arc tube 11, the light condensing area heated with the infrared radiation is restricted to a narrow area on the upper end portion of the arc tube 11. This arrangement further prevents the residual part of the arc tube 11 from being unnecessarily heated and thereby prevents the luminescent substances from flying out of the arc tube 11.

Figure 22:
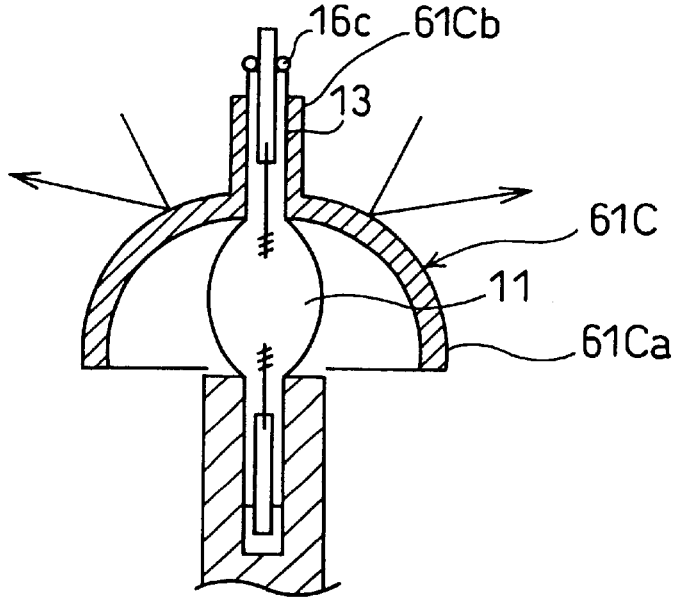
FIG. 22 is a sectional view illustrating a periphery of another infrared shield 61C in still another embodiment according to the present invention.

FIG. 22 is a sectional view illustrating the arc tube 11 in still another embodiment according to the present invention. An infrared shield 61C is set on the upper small-diametral portion 13 of the arc tube 11 as shown in FIG. 22. The infrared shield 61C includes a dome section 61Ca to cover the large-diametral portion 12 and a tubular support section 61Cb integrally formed with and disposed above the dome section 61Ca. The upper small-diametral portion 13 is fitted in and supported by the tubular support section 61Cb. Fitting the upper small-diametral portion 13 into the tubular support section 61Cb causes the infrared shield 61C to be set on the upper portion of the arc tube 11. The dome section 61Ca of the infrared shield 61C is designed to be greater than and cover the large-diametral portion 12. The infrared shield 61C is accordingly applicable for a variety of arc tubes 11 with different sizes of the large diametral portion 12. The infrared shield 61C is directly set on the upper portion of the arc tube 11. This arrangement enables only a sufficiently narrow area to be irradiated with infrared emission and ensures the sealing with the glass ring 16*c*.

Figure 23:
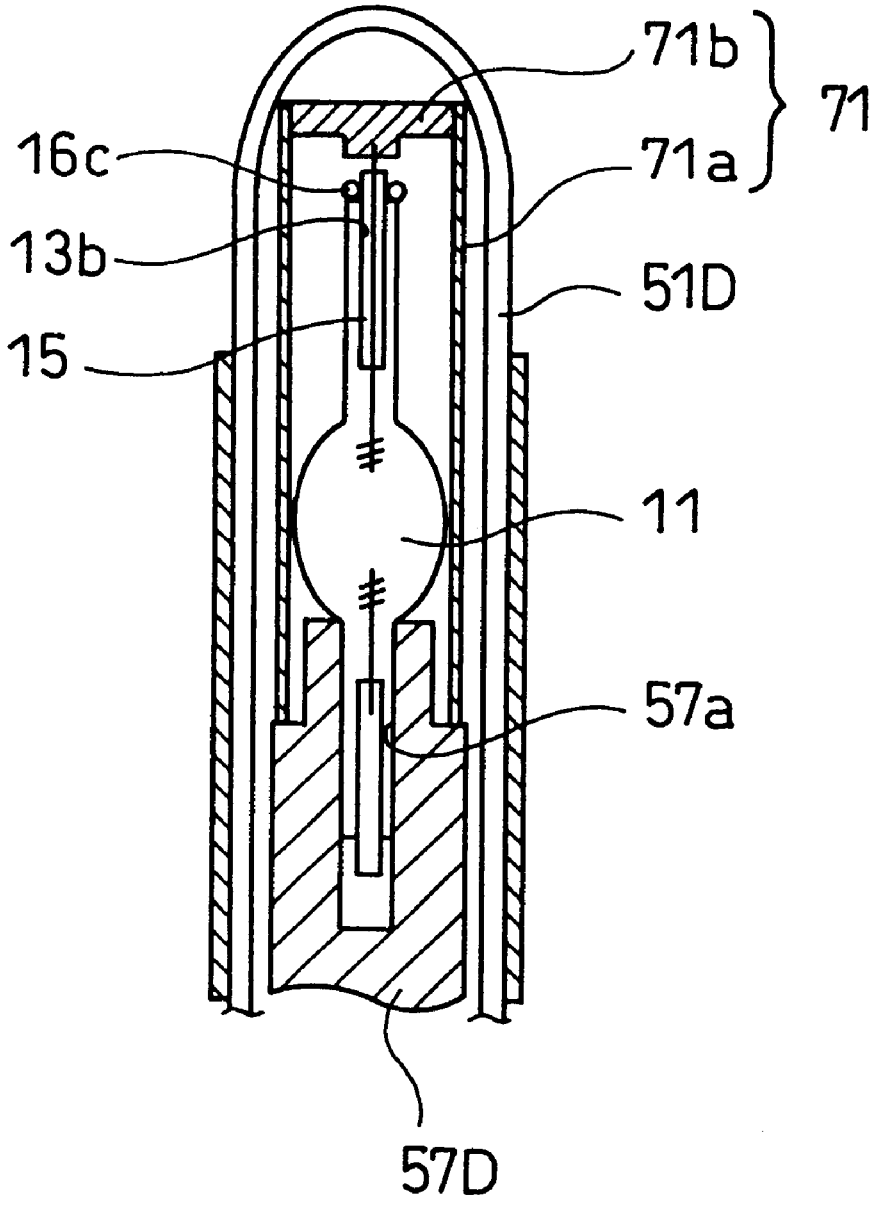
FIG. 23 is a sectional view illustrating still another feeding conduit 51D in another embodiment according to the present invention.

FIG. 23 is a sectional view illustrating an upper portion of another feeding conduit 51D in another embodiment according to the present invention. A support jig 57D and a sealed tube 71 are placed in the feeding conduit 51D as shown in FIG. 23. The sealed tube 71 is placed on the support jig 57D and includes a cylindrical body 71*a* and a suspension jig 71*b* for sealing an upper opening of the cylindrical body 71*a*. The center of the suspension jig 71*b* suspends the upper end of the electrode member 15 fitted in the opening 13*b* of the arc tube 11.

The sealing process with the support jig 57D and the sealed tube 71 first inserts one end of the arc tube 11 into the support aperture 57*a* of the support jig 57D in the operation box 31 (see FIG. 15). After the electrode member 15 with the glass ring 16*c* set thereon is attached to the suspension jig 71*b*, the suspension jig 71*b* is set in the upper opening of the cylindrical body 71*a*. The sealed tube 71 is then placed on the support jig 57D. At this moment, the lower end of the electrode member 15 is inserted into the opening 13*b* of the arc tube 11. This process causes the electrode member 15 to be suspended by the suspension jig 71*b*. The sealing process is then carried out to seal the electrode member 15 in this state. Using the support jig 57D and the sealed tube 71 enables the electrode member 15 to be securely welded to a specified position of the opening 13*b* of the arc tube 11 without causing a downward positional deviation of the electrode member 15 due to the fusion of the glass ring 16*c*.

Figure 24:
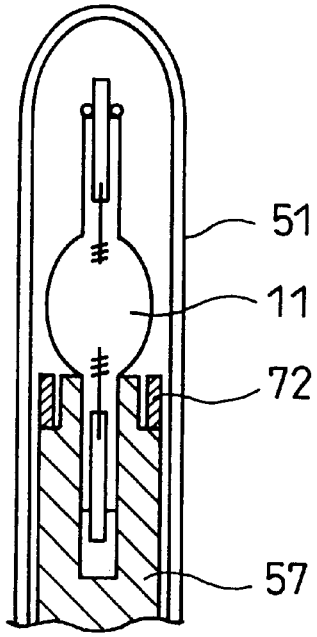
FIG. 24 is a sectional view illustrating the feeding conduit 51 with a getter 72 placed therein.

FIG. 24 is a sectional view illustrating the upper portion of the feeding conduit 51 in still another embodiment according to the present invention. A getter 72 is located around the upper end of the support jig 57 inside the feeding conduit 51 as shown in FIG. 24. The getter 72 adsorbs and removes impurities in the feeding conduit 51. The getter 72 removes the impurities, which have entered the feeding conduit 51 in the sealing process, and thereby prevents the inside of the arc tube 11 from being contaminated with the impurities.

Figure 25:
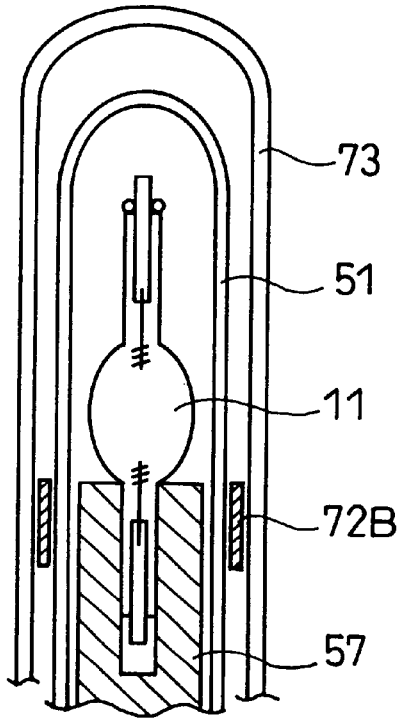
FIG. 25 is a sectional view showing a modification of the structure shown in FIG. 24.

As shown in FIG. 25, a quartz outer tube 73 may be disposed outside the feeding conduit 51 via a certain space, in which a getter 72B is located. In this structure, the outer tube 73 functions as a barrier that prevents impurities from entering the feeding conduit 51, while the getter 72B adsorbs and removes the impurities. This structure further prevents the inside of the arc tube 11 from being contaminated with impurities.

The following describes a variety of possible arrangements that restrain a temperature rise in the arc tube 11 in the sealing process and thereby prevent the luminescent substances from being vaporized and escaped from the arc tube 11.

(1) The support jig 57 shown in FIG. 16 is mainly made of a metal material, such as Al or Cu, to have a greater thermal conductivity than that of the arc tube 11 mainly made of $Al_2O_3$. The difference in thermal conductivity enables heat to be readily escaped from the arc tube 11 to the support jig 57 in the sealing process and thereby prevents a temperature rise in the arc tube 11.

Figure 26:
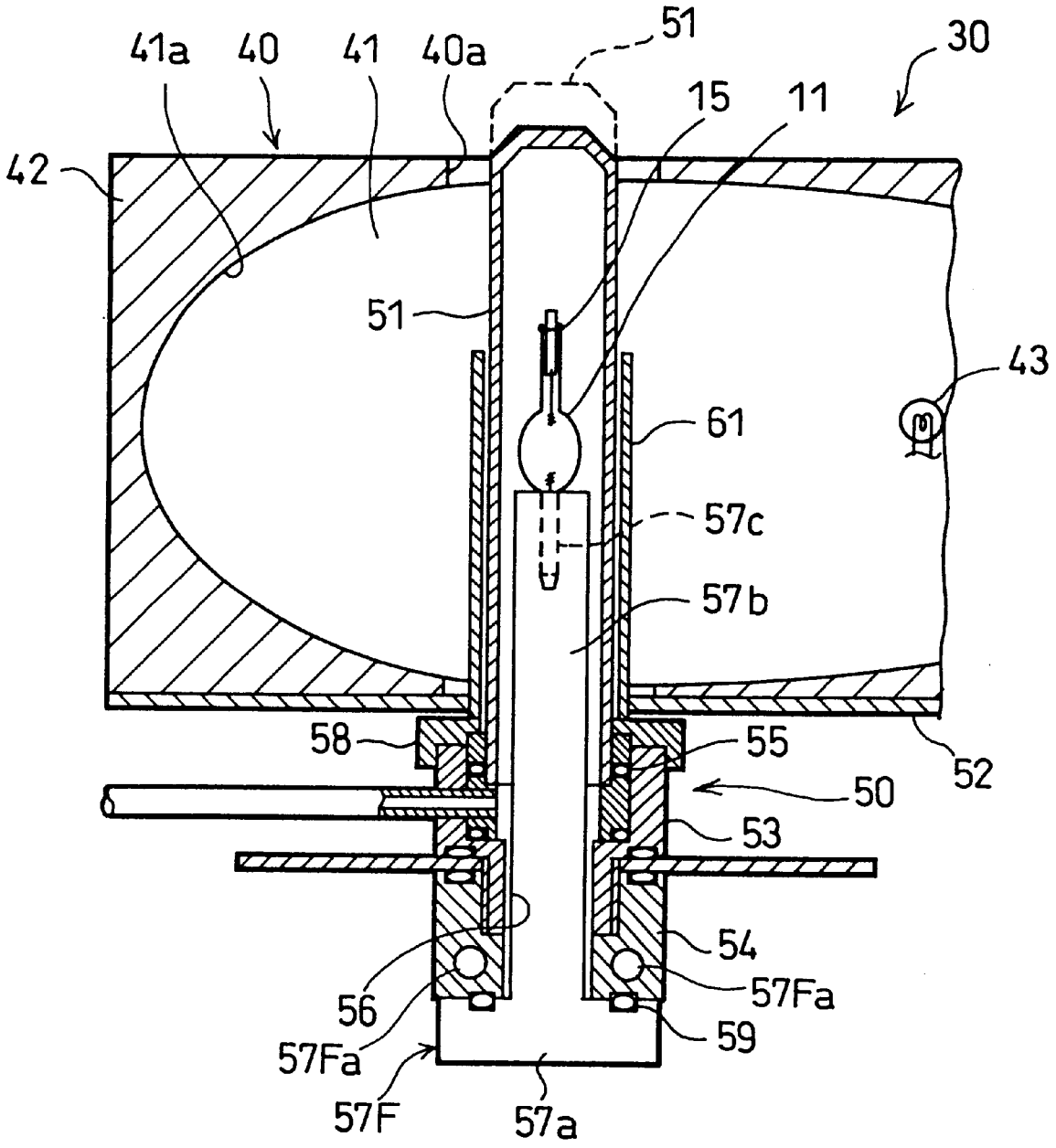
FIG. 26 is a sectional view illustrating a periphery of a support jig 57F in still another embodiment according to the present invention.

(2) A cooling passage 57Fa, through which a coolant flows, is formed in the lower part of a support jig 57F in the example of FIG. 26. The cooling passage 57Fa cools the support jig 57F down to enhance the heat conduction from the arc tube 11 to the support jig 57F and thereby prevents a temperature rise in the arc tube 11.

Figure 27:
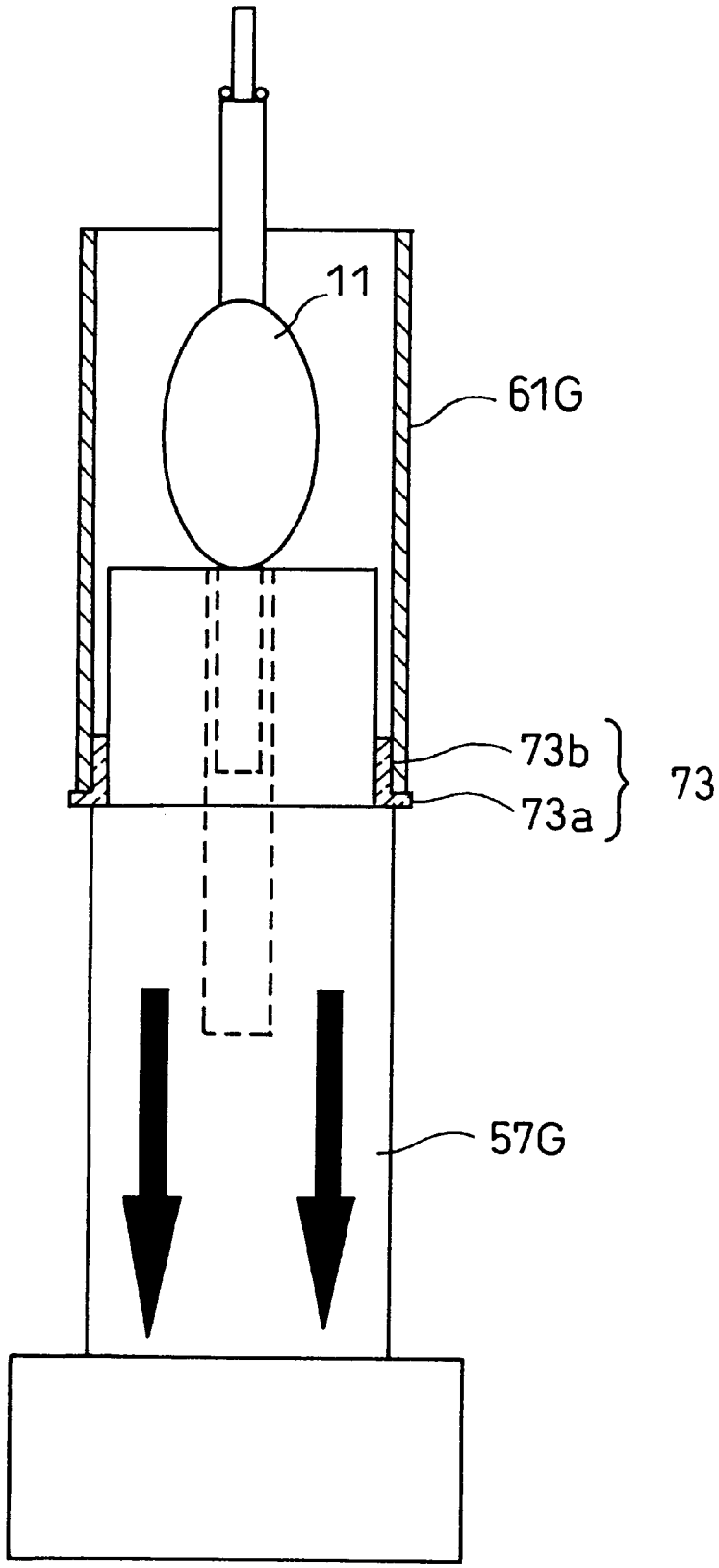
FIG. 27 is a sectional view illustrating a support jig 57G in another embodiment according to the present invention.

(3) FIG. 27 is a sectional view illustrating a support jig 57G in another embodiment according to the present invention. An infrared shield 61G is set on the support jig 57G via a heat-insulator 73 as shown in FIG. 27. The heat-insulator 73 includes a ring-shaped flange 73*a* placed on the upper face of the support jig 57G and a cylindrical body 73*b* that is extended from the flange 73*a* to be fitted in the inner wall of the infrared shield 61G. The flange 73*a* and the cylindrical body 73*b* are integrally formed with each other and mainly made of $Al_2O_3$. The temperature of the infrared shield 61G increases under emission of heat from the infrared lamp 43. Interposition of the heat-insulator 73 having a lower thermal conductivity between the infrared shield 61G and the support jig 57G reduces the quantity of heat conducted from the infrared shield 61G to the support jig 57G. This effectively prevents a temperature rise in the arc tube 11 due to the heat conducted from the support jig 57G. The infrared shield 61G is preferably made of a material having a low infrared absorptance, such as Pt. Such material restrains a temperature rise of the infrared shield 61G. One preferable application provides a plurality of heat-insulators 73 having different lengths and selectively uses one heat-insulator 73 having an appropriate length, so as to correspond to the arc tube 11 of a different length without changing the infrared shield 61G.

Figure 28:
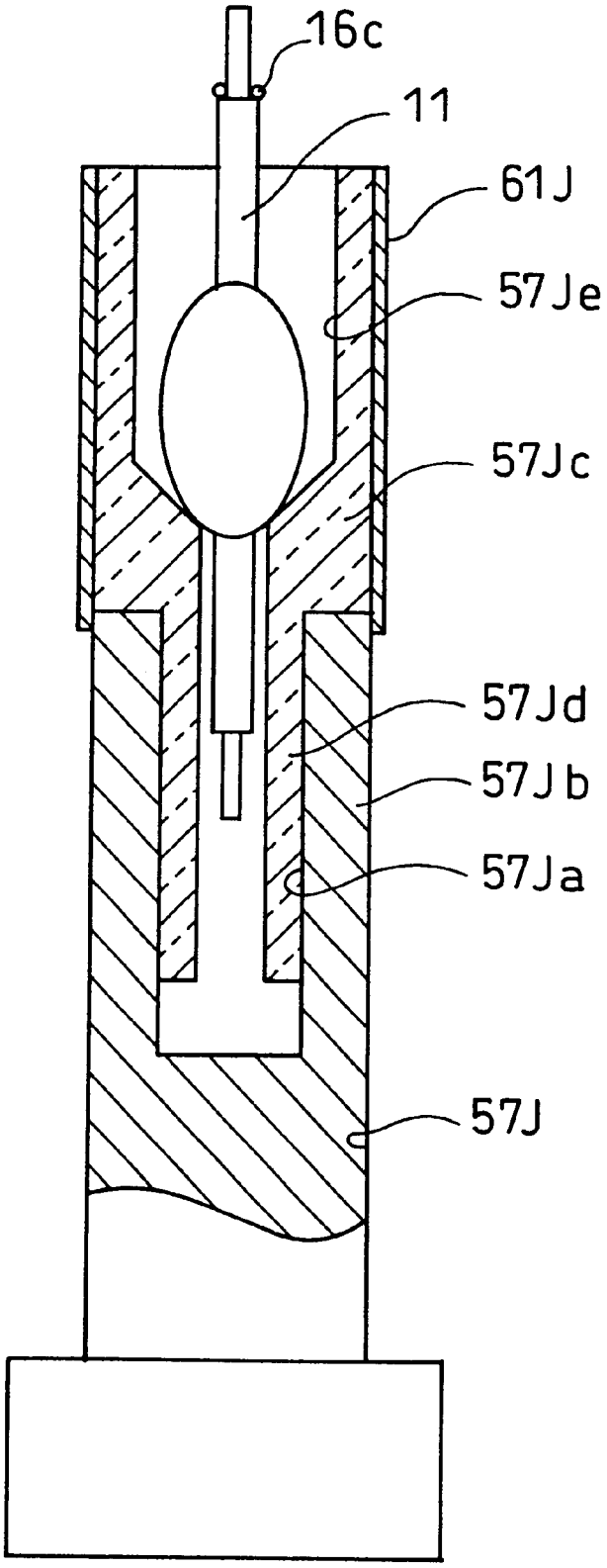
FIG. 28 is a sectional view illustrating a periphery of still another support jig 57J in another embodiment according to the present invention.

(4) FIG. 28 is a sectional view illustrating a configuration in which an infrared shielding function is attained by a part of a support jig 57J. The support jig 57J includes a support base 57Jb having a support aperture 57Ja formed in an upper portion thereof, and a support 57Jc. The support 57Jc has a support projection 57Jd that is screwed to the support aperture 57Ja of the support base 57Jb, and a support recess 57Je that is formed in an upper portion of the support 57Jc to support the arc tube 11. The support 57Jc is integrally formed and mainly made of $Al_2O_3$. The support recess 57Je is designed to support the lower portion of the arc tube 11 by the lower end thereof and cover the arc tube 11 except its upper end. An infrared reflector 61J, which is made of a material having a high infrared reflectivity (for example, Pt), is disposed around the support 57Jc.

In the course of the infrared emission in the sealing process, the support 57Jc of the support jig 57J, which covers the arc tube 11 supported by the support recess 57Je, shields the infrared radiation and prevents a temperature rise in the arc tube 11, thereby enabling only a periphery of the glass ring 16*c* set on the arc tube 11 to be heated. The heat of the infrared reflector 61J is mostly conducted to the support base 57Jb that is made of a metal having a high thermal conductivity and hardly conducted to the support 57Jc that is made of $Al_2O_3$ having a low thermal conductivity. In this structure, the support 57Jc for supporting the arc tube 11 does not accordingly have high temperatures. This arrangement effectively prevents a temperature rise in the arc tube 11.

The infrared lamp 43 placed in the heating chamber 41 of the heating unit 40 shown in FIG. 16 may be located at any position that enables part of the arc tube 11 in the feeding conduit 51 to be heated in a homogeneous manner. A variety of other configurations are applicable as shown in FIGS. 29 and 30.

Figure 29:
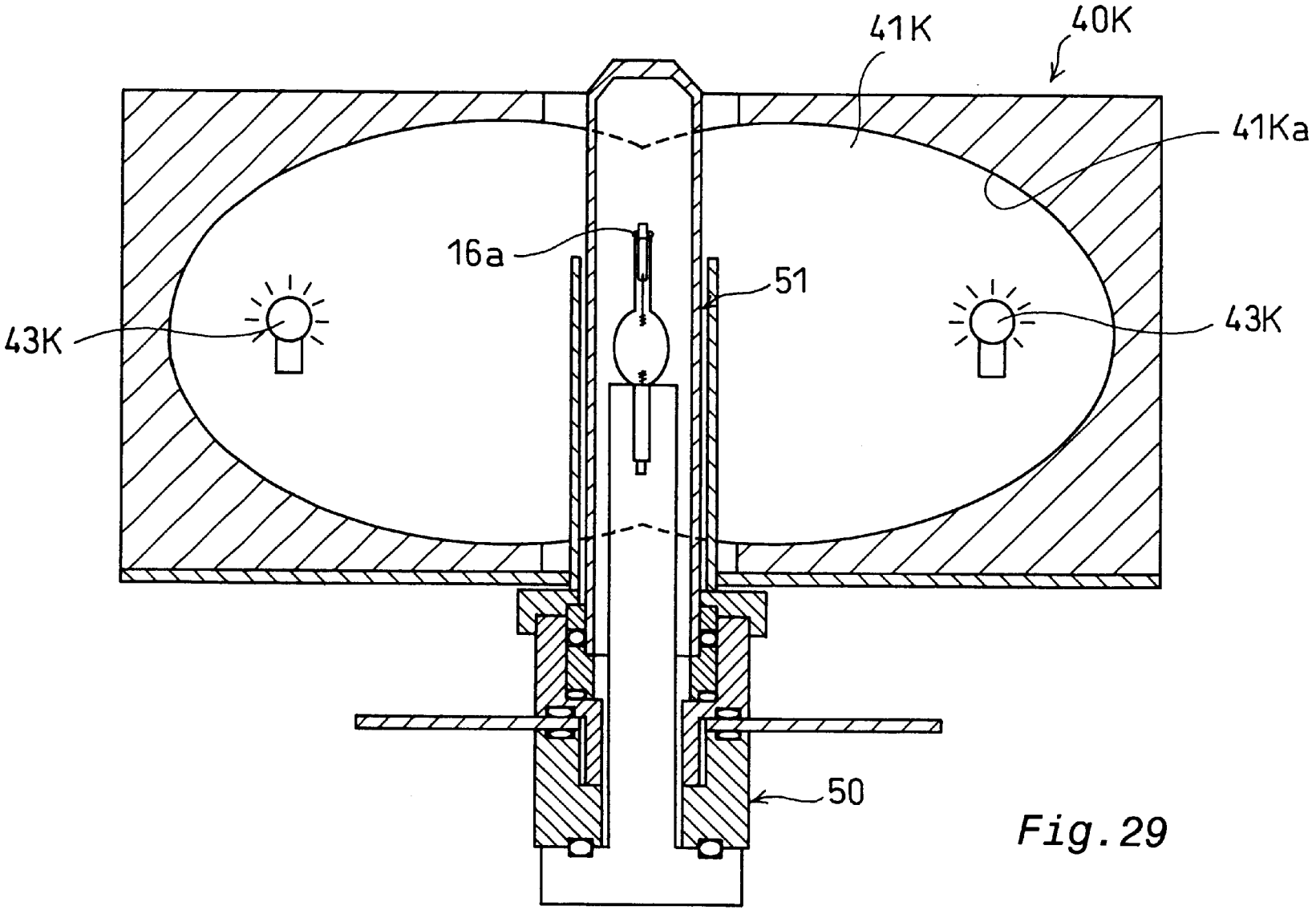
FIG. 29 is a sectional view illustrating another heating unit 40K in still another embodiment according to the present invention.

(1) Referring to FIG. 29, a heating chamber 41K of a heating unit 40K is wide and has a reflecting plane 41Ka formed on the inner surface thereof. A pair of infrared lamps 43K,43K are placed on the left and right sides of the feeding conduit 51 inside the heating chamber 41K. The pair of infrared lamps 43K,43K are arranged symmetrically about the feeding conduit 51. This arrangement of the infrared lamps 43K,43K on both sides of the feeding conduit 51 enables the circumference of the glass ring 16*c* to be homogeneously irradiated with the infrared emission.

Figure 30:
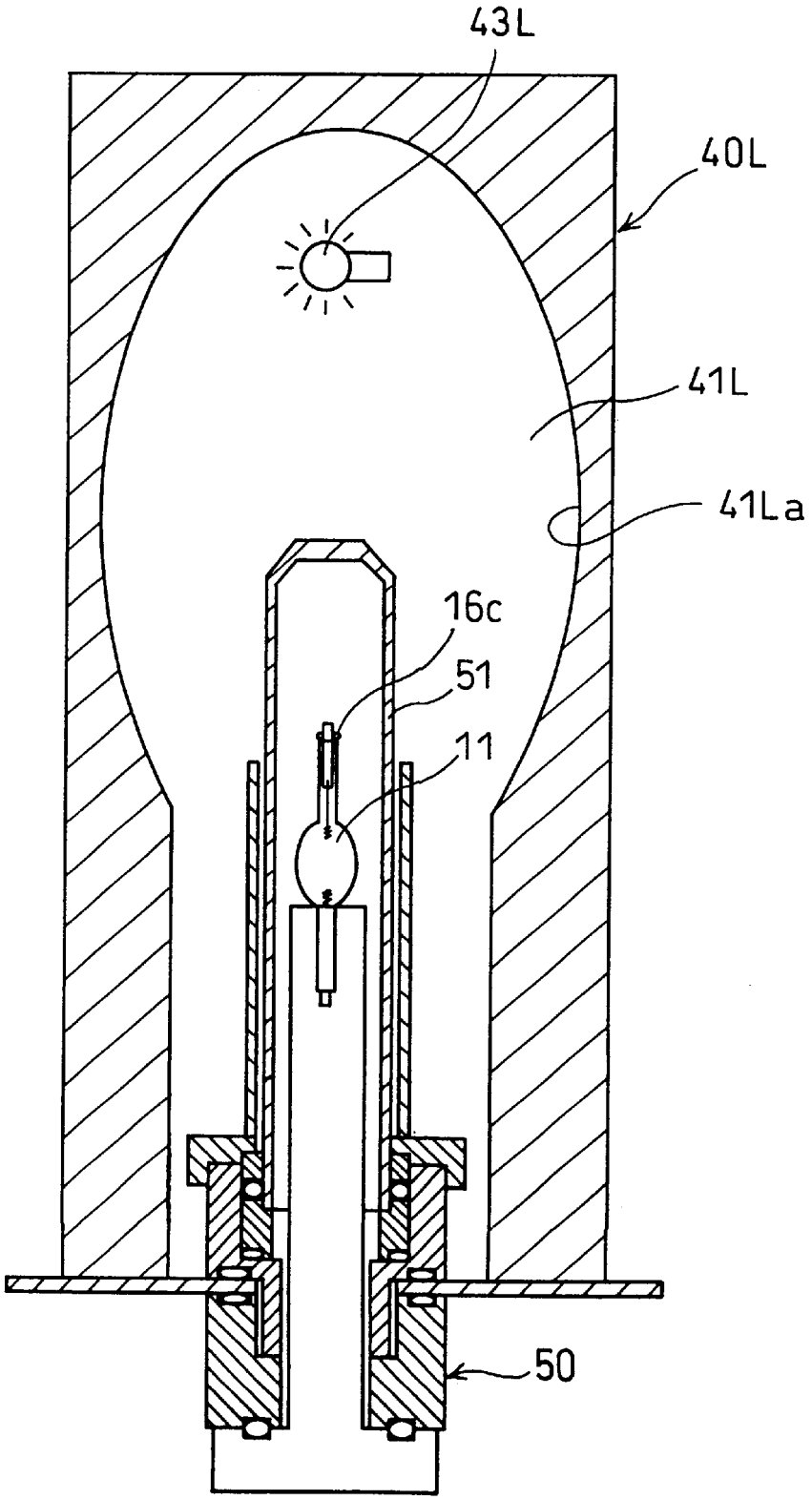
FIG. 30 is a sectional view illustrating still another heating unit 40L in another embodiment according to the present invention.

(2) Referring to FIG. 30, a heating chamber 41L of a heating unit 40L is long and has a reflecting plane 41La formed on the inner surface thereof. An infrared lamp 43L is placed above the feeding conduit 51 in the heating chamber 41L. The glass ring 16*c* placed on the arc tube 11 is irradiated directly and via the reflecting plane 41La in a substantially homogeneous manner with the infrared radiation emitted downward from the infrared lamp 43. This arrangement is free from the unsuccessful sealing due to the uneven heating of the glass ring 16*c*.

(3) The means for condensing the infrared radiation to a specific area for sealing in the heating unit may be a condenser lens, instead of the configuration that makes the emission from the infrared lamp reflected from the reflecting plane.

It is preferable that a pre-treatment discussed below is performed to remove the impurities adhering to the surface of the supplies including the arc tube 11 and the electrode member 15 when these supplies including the arc tube 11 and the electrode member 15 are fed into the operation box 31 in the example of FIGS. 15 and 16. After the supplies including the arc tube 11 are delivered to the operation box 31, the support jig 57 is lifted up while the arc tube 11 is supported on the support jig 57. This seals the arc tube 11 in the feeding conduit 51. In the state that the infrared shield 61 is lowered to the position that does not cover the arc tube 11, the supply of electricity to the infrared lamp 43 is gradually increased to raise the temperatures in the feeding conduit 51 and in the arc tube 11. The temperature rises of the atmospheres in the arc tube 11 and in its periphery vaporize and remove the impurities adhering to, for example, the wall surface of the arc tube 11 and the electrode member 15. The pre-treatment may be performed with the same heating unit 40 or with another heating unit located adjacent to the heating unit 40. In the latter case, the pre-treatment and the series of the processing in the sealing process can be carried out in a continuous manner. This ensures the excellent productivity.

Industrial Applicability

The discharge lamp of the present invention has a high luminance and is thus applicable for a light source of projection televisions.

What is claimed is:

1. An apparatus for sealing a discharge lamp, the apparatus fusing a sealing glass to seal an opening of an arc tube, through which opening a luminescent substance has been charged into the arc tube, the apparatus comprising:

a support jig that supports the arc tube, which arc tube is provided with the sealing glass placed around a circumference of the opening; and an infrared irradiation unit that emits infrared radiation to fuse the sealing glass, wherein the support jig is mainly made of a material that has a greater thermal conductivity than that of the arc tube, and the infrared irradiation unit includes an infrared lamp and a reflecting plane, the reflecting plane comprising a concave mirror that reflects the infrared radiation from the infrared lamp and condenses the reflected infrared radiation onto the sealing glass.

2. An apparatus for sealing a discharge lamp, the apparatus fusing a sealing glass to seal an opening of an arc tube, through which opening a luminescent substance has been charged into the arc tube, the apparatus comprising:

a support jig that supports the arc tube, which arc tube is provided with the sealing glass placed around a circumference of the opening;

an infrared irradiation unit that emits infrared radiation to fuse the sealing glass; and a cooling unit that cools the support jig to enhance heat conduction from the arc tube to the support jig; and the infrared irradiation unit includes an infrared lamp and a reflecting plane, the reflecting plane comprising a concave mirror that reflects the infrared radiation from the infrared lamp and condenses the reflected infrared radiation onto the sealing glass.

3. An apparatus for sealing a discharge lamp, the apparatus fusing a sealing glass to seal an opening of an arc tube, through which opening a luminescent substance has been charged into the arc tube, the apparatus comprising:

a support jig that supports the arc tube, which arc tube is provided with the sealing glass placed around a circumference of the opening; and an infrared irradiation unit that emits infrared radiation to fuse the sealing glass, wherein the support jig is mainly made of a material that has a greater thermal conductivity than that of the arc tube; and an infrared shield that covers the arc tube in order to restrict the infrared radiation emitted from the infrared irradiation unit to a periphery of the sealing glass, wherein the infrared shield is attached to the support jig in such a manner that the infrared shield is not in direct contact with the arc tube.

4. An apparatus for sealing a discharge lamp in accordance with claim 3, wherein a heat-insulator having a smaller thermal conductivity than that of the infrared shield is interposed between the infrared shield and the support jig.

5. A method of sealing a discharge lamp which an infrared irradiation unit fuses a sealing glass to seal an opening of an arc tube, through which a luminescent substance has been charged into the arc tube, the infrared irradiation unit including an infrared lamp and a reflecting plane, the reflecting plane comprising a concave mirror that reflects the infrared radiation from the infrared lamp and condenses the reflected infrared radiation onto the sealing glass, the method comprising the steps of:

supporting one end of the arc tube with a support jig;

placing the sealing glass around a circumference of the opening; and irradiating the sealing glass with infrared emission to fuse the sealing glass and thereby seal the opening; and cooling the support jig.

6. An apparatus for sealing a discharge lamp, the apparatus fusing a sealing glass to seal an opening of an arc tube, through which a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed around a circumference of the opening of the arc tube, wherein the heating unit has an opening, through which one end of the feeding conduit is protruded outward.

7. An apparatus for sealing a discharge lamp, the apparatus fusing a sealing glass to seal an opening of an arc tube, through which a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed on the arc tube, wherein the heating unit has a transparent window that enables a user to observe a state of fusing the sealing glass and sealing the opening of the arc tube.

8. An apparatus for sealing a discharge lamp, the apparatus fusing a sealing glass to seal an opening of an arc tube, through which a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed on the arc tube, wherein the heating unit has: a flow length detection unit that measures a flow length of the fused sealing glass flown into the arc tube; and a heating control unit that stops the emission of the infrared irradiation unit when the flow length of the fused sealing glass measured by the flow length detection unit becomes not less than a predetermined value.

9. A method of sealing a discharge lamp by fusing a sealing glass to seal an opening of an arc tube, through which a luminescent substance has been charged into the arc tube, the method comprising the steps of:

setting the sealing glass around a circumference of the opening;

fusing the sealing glass; and cooling down the fused sealing glass rapidly enough to make the sealing glass amorphous and thereby seal the opening.

10. An apparatus for sealing a discharge lamp, the apparatus fusing a sealing glass to seal an opening of an arc tube, through which a luminescent substance has been charged into the arc tube, the apparatus comprising:

a support jig that supports one end of the arc tube;

a feeding conduit that is arranged to cover the arc tube in an air-tight condition;

an infrared irradiation unit that emits infrared radiation to fuse the sealing glass;

wherein the infrared irradiation unit includes an infrared lamp and a reflecting plane, the reflecting plane comprising a concave mirror that reflects the infrared radiation from the infrared lamp and condenses the reflected infrared radiation onto the sealing glass.

11. An apparatus for sealing a discharge lamp in accordance with claim 10, the apparatus further comprising:

an atmosphere regulation unit that regulates an atmosphere in the feeding conduit in the air-tight condition.

12. An apparatus for sealing a discharge lamp, the apparatus fusing a sealing glass to seal an opening of an arc tube, through which opening a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed on the arc tube; and an infrared shield that is disposed around a circumference of the arc tube to condense the infrared radiation only on a periphery of the sealing glass and shield a residual part of the arc tube from the infrared radiation.

13. An apparatus for sealing a discharge lamp, the apparatus fusing a sealing glass to seal an opening of an arc tube, through which opening a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed on the arc tube; and wherein an adsorbent for adsorbing at least one impurity, which is not desired to be sealed in the arc tube, is placed in the feeding conduit.

14. An apparatus for sealing a discharge lamp, the apparatus fusing a sealing glass to seal an opening of an arc tube, through which arc tube opening a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed on the arc tube, wherein the support jig has a suspension jig that prevents an electrode member from dropping in the arc tube in the course of heating by the infrared irradiation unit.

15. A method of sealing a discharge lamp, the method irradiating a sealing glass with infrared emission to fuse the sealing glass and thereby seal an opening of an arc tube, through which an electrode member with an electrode element is inserted into the arc tube, the method comprising the steps of:

setting the sealing glass around a circumference of the opening;

regulating an atmosphere to make a pressure in the arc tube lower than an external pressure and cause a pressure difference; and heating and fusing the sealing glass to make the fused sealing glass flown into a gap between the electrode member and a wall surface of the opening by mean of the pressure difference.

16. A method of sealing a discharge lamp by fusing a sealing glass to seal an opening of an arc tube, through which opening a luminescent substance has been charged into the arc tube, wherein the sealing glass comprises $Al_2O_3$—$SiO_2$ as a primary constituent and further contains an infrared absorbent to enhance absorptance of infrared radiation, the infrared absorbent being no less than 46.5 wt % such that the sealing glass is colored.

17. A method in accordance with claim 16, wherein the infrared absorbent is at least one selected among the group consisting of $CeO_2$, $SM_2O_3$, $Ho_2O_3$, $DY_2O_3$, $Er_2O_3$, and $Nd_2O_3$.

18. An apparatus for sealing a discharge lamp, the apparatus fusing a sealing glass to seal an opening of an arc tube, through which opening a luminescent substance has been charged into the arc tube, the apparatus comprising:

a support jig that supports the arc tube, the arc tube is provided with the sealing glass placed around a circumference of the opening;

an infrared irradiation unit that emits infrared radiation to fuse the sealing glass; and a cooling unit that cools the support jig to enhance heat conduction from the arc tube to the support jig; and an infrared shield that covers the arc tube in order to restrict the infrared radiation emitted from the infrared irradiation unit to a periphery of the sealing glass, wherein the infrared shield is attached to the support jig in such a manner that the infrared shield is not in direct contact with the arc tube.

19. An apparatus for sealing a discharge lamp in accordance with claim 18, wherein a heat-insulator having a smaller thermal conductivity than that of the infrared shield is interposed between the infrared shield and the support jig.

20. A method of sealing a discharge lamp by fusing a sealing glass to seal an opening of an arc tube, through which opening a luminescent substance has been charged into the arc tube, wherein the sealing glass comprises $Al_2O_3$—$SiO_2$, as a primary constituent and an infrared absorbent to enhance absorbency of infrared radiation, the infrared absorbent being applied onto a surface of the sealing glass.

21. An apparatus for sealing a discharge lamp, the apparatus fusing a sealing glass to seal an opening of an arc tube, through which opening a luminescent substance has been charged into the arc tube, the apparatus comprising:

a support jig that supports one end of the arc tube;

a feeding conduit that is arranged to cover the arc tube in an air-tight condition;

an infrared irradiation unit; and a heating unit that condenses infrared radiation emitted from the infrared irradiation unit on a predetermined light condensing area, in order to fuse the sealing glass placed on the arc tube; and the infrared irradiation unit includes an infrared lamp and a reflecting plane, the reflecting plane comprising a concave mirror that reflects the infrared radiation from the infrared lamp and condenses the reflected infrared radiation to the sealing glass.

22. An apparatus for sealing a discharge lamp, the apparatus fusing a sealing glass to seal an opening of an arc tube, though which a luminescent substance has been charged into the arc tube, the apparatus comprising:

a support jig that supports the arc tube, which arc tube is provided with the sealing glass placed around a circumference of the opening;

an infrared irradiation unit that emits infrared radiation to fuse the sealing glass;

a cooling unit that cools the support jig to enhance heat conduction from the arc tube to the support jig;

an infrared shield that covers the arc tube in order to restrict the infrared radiation emitted from the infrared irradiation unit to a periphery of the sealing glass, wherein the infrared shield is attached to the support jig in such a manner that the infrared shield is not in direct contact with the arc tube.

23. An apparatus for sealing a discharge lamp in accordance with claim 22, wherein a heat-insulator having a smaller thermal conductivity than that of the infrared shield is interposed between the infrared shield and the support jig.

* * * * *